US008699898B2

(12) United States Patent
Kikuchi et al.

(10) Patent No.: US 8,699,898 B2
(45) Date of Patent: Apr. 15, 2014

(54) APPARATUS AND METHOD FOR CHANGING A VOLTAGE SETTING FOR AN IMAGE FORMING APPARATUS

(75) Inventors: Hisashi Kikuchi, Kanagawa (JP); Takaya Muraishi, Kanagawa (JP); Kenji Sugiura, Kanagawa (JP); Akira Asaoka, Kanagawa (JP); Yoshiki Hozumi, Kanagawa (JP); Yuu Sakakibara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 177 days.

(21) Appl. No.: 13/313,710

(22) Filed: Dec. 7, 2011

(65) Prior Publication Data

US 2012/0224870 A1 Sep. 6, 2012

(30) Foreign Application Priority Data

Mar. 4, 2011 (JP) ..... 2011-047717

(51) Int. Cl.
*G03G 15/00* (2006.01)
*G03G 15/16* (2006.01)
*G03G 21/00* (2006.01)

(52) U.S. Cl.
USPC ..... 399/44; 399/71; 399/101; 399/354

(58) Field of Classification Search
USPC ..... 388/44, 71, 101, 354; 399/44, 71, 101, 399/354
See application file for complete search history.

(56) References Cited

U.S. PATENT DOCUMENTS 5,416,572 A * 5/1995 Kolb et al. ..... 399/350
5,493,383 A * 2/1996 Pozniakas et al. ..... 399/345
5,519,480 A * 5/1996 Thayer et al. ..... 399/355
5,559,593 A * 9/1996 Yoshinaga et al. ..... 399/343
5,646,717 A * 7/1997 Hiroshima et al. ..... 399/154
5,878,317 A 3/1999 Masuda et al.
6,185,396 B1 * 2/2001 Aizawa et al. ..... 399/121
6,311,031 B1 * 10/2001 Hirano ..... 399/101
6,477,344 B1 * 11/2002 Asakura et al. ..... 399/101

(Continued)

FOREIGN PATENT DOCUMENTS

JP 63-219624 9/1988
JP 1-183520 7/1989

(Continued)

OTHER PUBLICATIONS

Machine translation of JP 2006053594.*

(Continued)

*Primary Examiner* — Walter L Lindsay, Jr.
*Assistant Examiner* — David Bolduc
(74) *Attorney, Agent, or Firm* — Oblon, Spivak, McClelland, Maier & Neustadt, L.L.P.

(57) ABSTRACT

An image forming apparatus including a setting memory storing multiple voltage settings; two or more voltage applying members each contacting a voltage applied member at respective contact positions close to each other, which are simultaneously being applied with respective voltages selected from the voltage settings; two or more current detectors each detecting a current flowing in the respective contact positions; and a setting changer performing a setting changing processing in which the voltage applied to one of the voltage applying members is changed based on the current detected by the corresponding current detector while a predetermined voltage is applied to the other voltage applying members, so that an optimum current flows in the corresponding contact position.

14 Claims, 6 Drawing Sheets

(56) References Cited

U.S. PATENT DOCUMENTS

| | | | | |
|---|---|---|---|---|
| 6,987,944 | B2 | 1/2006 | Shakuto et al. | |
| 6,999,694 | B2 * | 2/2006 | Takami | 399/71 |
| 7,103,301 | B2 | 9/2006 | Watanabe et al. | |
| 7,123,869 | B2 * | 10/2006 | Yamane et al. | 399/297 |
| 7,209,699 | B2 | 4/2007 | Yamaguchi et al. | |
| 7,215,920 | B2 * | 5/2007 | Shida | 399/354 |
| 7,263,308 | B2 | 8/2007 | Harada et al. | |
| 7,376,380 | B2 | 5/2008 | Koike et al. | |
| 7,496,324 | B2 | 2/2009 | Sugiura et al. | |
| 7,505,728 | B2 | 3/2009 | Yamaguchi et al. | |
| 7,603,071 | B2 | 10/2009 | Sugiura et al. | |
| 7,627,263 | B2 * | 12/2009 | Takishita | 399/101 |
| 7,835,683 | B2 | 11/2010 | Muraishi et al. | |
| 7,899,383 | B2 | 3/2011 | Shintani et al. | |
| 7,945,202 | B2 * | 5/2011 | Kimura et al. | 399/353 |
| 7,970,298 | B2 * | 6/2011 | Nishikawa | 399/43 |
| 8,019,268 | B2 | 9/2011 | Nakamatsu et al. | |
| 8,180,265 | B2 * | 5/2012 | Takishita | 399/297 |
| 8,208,822 | B2 * | 6/2012 | Nishikawa | 399/43 |
| 2005/0058474 | A1 | 3/2005 | Watanabe et al. | |
| 2006/0083531 | A1 * | 4/2006 | Shida | 399/71 |
| 2006/0083539 | A1 * | 4/2006 | Nishikawa | 399/101 |
| 2006/0171735 | A1 * | 8/2006 | Hamada et al. | 399/101 |
| 2006/0210300 | A1 * | 9/2006 | Nishikawa | 399/101 |
| 2007/0014605 | A1 * | 1/2007 | Facci et al. | 399/346 |
| 2007/0036578 | A1 * | 2/2007 | Fukami et al. | 399/101 |
| 2007/0059027 | A1 * | 3/2007 | Ishikawa et al. | 399/101 |
| 2007/0059028 | A1 * | 3/2007 | Nishikawa | 399/101 |
| 2007/0230993 | A1 * | 10/2007 | Takeuchi | 399/101 |
| 2007/0286621 | A1 * | 12/2007 | Nishikawa | 399/49 |
| 2008/0273891 | A1 * | 11/2008 | Hamada et al. | 399/71 |
| 2009/0129798 | A1 * | 5/2009 | Nishida et al. | 399/48 |
| 2009/0176669 | A1 | 7/2009 | Sugiura et al. | |
| 2009/0232530 | A1 * | 9/2009 | Saito et al. | 399/50 |
| 2010/0196026 | A1 * | 8/2010 | Shida | 399/44 |
| 2010/0232824 | A1 * | 9/2010 | Shibuya et al. | 399/71 |
| 2010/0239302 | A1 | 9/2010 | Naruse et al. | |
| 2011/0103822 | A1 | 5/2011 | Sugiura et al. | |
| 2011/0229187 | A1 | 9/2011 | Hozumi et al. | |
| 2011/0262170 | A1 * | 10/2011 | Kozuma et al. | 399/71 |
| 2012/0039623 | A1 * | 2/2012 | Hiramatsu et al. | 399/98 |
| 2012/0087704 | A1 * | 4/2012 | Asaoka et al. | 399/350 |

FOREIGN PATENT DOCUMENTS

| | | | |
|---|---|---|---|
| JP | 1-213411 | | 8/1989 |
| JP | 1-292116 | | 11/1989 |
| JP | 10-131035 | | 5/1998 |
| JP | 10-310974 | | 11/1998 |
| JP | 2005316102 | A * | 11/2005 |
| JP | 2006053594 | A * | 2/2006 |
| JP | 2006-119305 | | 5/2006 |
| JP | 2007-272091 | | 10/2007 |
| JP | 2009-258541 | | 11/2009 |

OTHER PUBLICATIONS

U.S. Appl. No. 13/253,330, filed Oct. 5, 2011, Akira Asaoka, et al.
U.S. Appl. No. 13/271,636, filed Oct. 12, 2011, Hisashi Kikuchi, et al.

* cited by examiner

APPARATUS AND METHOD FOR CHANGING A VOLTAGE SETTING FOR AN IMAGE FORMING APPARATUS

CROSS-REFERENCE TO RELATED APPLICATIONS

This patent application is based on and claims priority pursuant to 35 U.S.C. §119 to Japanese Patent Application No. 2011-047717, filed on Mar. 4, 2011, in the Japanese Patent Office, the entire disclosure of which is hereby incorporated herein by reference.

FIELD OF THE INVENTION

The present invention relates to an image forming apparatus, such as a copier, a facsimile machine, and a printer. More specifically, the present invention relates to an image forming apparatus including two or more voltage applying members each contacting a voltage applied member, such as an image bearing member or a recording medium conveying member, at respective contact positions close to each other.

BACKGROUND OF THE INVENTION

Typical electrophotographic image forming apparatuses include a cleaner that removes residual toner particles from an image bearing member. Those employing an elastic blade as the cleaner are well-known. The elastic blade (hereinafter "cleaning blade") is typically pressed against a peripheral surface of the image bearing member to scrape off residual toner particles. The above system, what is called a blade cleaning system, is widely used because of having a simple configuration and stable performance. On the other hand, toners have been developed to be much smaller and more spherical to meet a recent demand for higher image quality. Small-sized toners are advantageous in producing high-definition and high-resolution images, and spherical toners are advantageous in improving development efficiency and transfer efficiency.

However, it is difficult for the blade cleaning system to remove small-sized and spherical toner particles for the following reasons. An edge of the cleaning blade is in frictional contact with a surface of the image bearing member during removal of toner particles. Therefore, a deformation is caused in the edge of the cleaning member due to the friction with the image bearing member, causing stick-slip phenomenon. Thus, a micro gap is formed between the image bearing member and the cleaning blade. The smaller toner particles are more likely to get in the micro gap. The more spherical toner particles are more likely to generate rotational moment to roll within the micro gap. Toner particles rolling within the micro gap push up the cleaning blade so that toner particles can undesirably get into between the cleaning blade and the image bearing member. As a result, the micro gap is so expanded that toner particles are permitted to slip through the micro gap. Small-sized and spherical toner particles are prevented from slipping through the micro gap only when the cleaning blade is pressed against the image bearing member with a high linear pressure. However, in this case, both the image bearing member and the cleaning blade may rapidly wear due to the high pressure, shorting their lifespan against the recent demand for high durability.

On the other hand, it is known that small-sized and spherical toner particles can be removed by what is called an electrostatic cleaning system. In the electrostatic cleaning system, a conductive cleaning member (i.e., a voltage applying member) electrostatically removes toner particles from an image bearing member upon application of a voltage having the opposite polarity to the toner.

Generally, residual toner particles to be removed with the cleaning member have various charge amount. Although most toner particles on an image bearing member have a normal polarity (e.g., negative polarity) before being transferred therefrom, a part of them shifts to the opposite polarity (e.g., positive polarity) upon application of a transfer electric field having the opposite polarity to the toner particles, due to the occurrence of opposite charge injection. As a result, residual toner particles remaining on the image bearing member have an undesirable broad charge distribution in which positive and negative toner particles are coexisting.

In attempting to solve the above problem, Japanese Patent Application Publication No. 2007-272091 proposes a cleaning device having two cleaning brushes. One of the cleaning brushes is applied with a voltage having the same polarity as the toner, and the other is applied with a voltage having the opposite polarity to the toner. It is disclosed therein that the two cleaning brushes can reliably remove both positive and negative toner particles from the image bearing member. Toner particles collected by the two cleaning brushes are further electrostatically collected by metallic rollers applied with a higher absolute voltage due to the potential difference therebetween.

The predetermined resistance values of the image bearing member and the cleaning brush are generally varied with time while a cleaning voltage, having been optimized according to the predetermined resistance values, is unchangeable. Thus, the gap between the predetermined and temporal resistance values causes defective cleaning of the image bearing member. In attempting to solve this problem, Japanese Patent Application Publication No. 2009-258541 proposes a method of controlling voltage to be applied to a cleaning brush so that an optimum amount of current flows. It is disclosed therein that electrostatic cleaning ability of the cleaning brush has a high correlation with the amount of current flowing in the contact portion of the cleaning brush with the image bearing member. The proposed method keeps flowing the optimum amount of current even when the resistance values of the image bearing member and the cleaning brush are varied so that the cleaning brush can always express high cleaning ability.

In the proposed method, voltages V1 and V2 are applied to respective cleaning brushes from direct current power sources, and currents I1 and I2 flowing in the respective cleaning brushes are detected. A current-voltage characteristic graph having a vertical axis indicating voltage and a lateral axis indicating current is linearly compiled from the above values V1, V2, I1, and I2 to determine the optimum voltage to obtain the optimum current to produce the best performance of the cleaning brushes.

To meet a recent demand for more compact apparatus, two cleaning members are required to be positioned much closer. This requirement has been found to raise a new problem.

In the conventional method described above, a voltage to be applied to each of the two cleaning members is independently controlled. Specifically, a voltage to be applied to one of the cleaning members is adjusted first, and subsequently a voltage to be applied to the other is adjusted. When the voltage thus previously adjusted is applied to the cleaning members during an actual cleaning procedure, an optimum amount of current flows when the two cleaning members are positioned far away from each other. However, when the two cleaning members are positioned close to each other, an optimum amount of current does not flow during an actual cleaning procedure even when the previously adjusted voltage is applied to the cleaning members. As a result, defective cleaning occurs.

The inventors of the present invention consider the reason for such defective cleaning as follows. The image bearing member has a relatively high resistance because it is required to bear charged toner particles without degrading their charge level. When two cleaning members are separately positioned while contacting the image bearing member, the resistive component connecting the two cleaning members is very high. Therefore, the two cleaning members can be regarded as being electrically independent. When two cleaning members are closely positioned while contacting the image bearing member, the resistive component connecting the two cleaning members is very low. Therefore, the two cleaning members cannot be regarded as being electrically independent. Upon application of a voltage to one of the cleaning members, the surface potential of the image bearing member at the contact portion with the other cleaning member is increased or decreased. Since the voltage to be applied to one of the cleaning members is previously adjusted under the condition that no voltage is applied to the other cleaning member, which is different from the actual cleaning conditions, the optimum amount of current cannot flow during the actual cleaning procedure. Because voltages applied to the two cleaning members are large and opposite in polarity, a voltage applied to the one of the cleaning members has no small effect on the amount of current flows in the other.

The above-described problem may arise not only in the case in which two cleaning members are closely positioned but also in a case in which two or more voltage applying members (e.g., transfer rollers installed in a tandem image forming apparatus) are closely positioned while contacting a voltage applied member (e.g., image bearing member, recording medium conveying member).

SUMMARY OF THE INVENTION

Exemplary aspects of the present invention are put forward in view of the above-described circumstances, and provide a compact image forming apparatus in which multiple voltage applying members, such as multiple cleaning members, reliably remove toner particles from a voltage applied member, such as an image bearing member or a recording medium conveying member, regardless of environmental condition.

In one exemplary embodiment, a novel image forming apparatus includes a setting memory storing multiple voltage settings; two or more voltage applying members each contacting a voltage applied member at respective contact positions close to each other, which are simultaneously being applied with respective voltages selected from the voltage settings; two or more current detectors each detecting a current flowing in the respective contact positions; and a setting changer performing a setting changing processing in which the voltage applied to one of the voltage applying members is changed based on the current detected by the corresponding current detector while a predetermined voltage is applied to the other voltage applying members, so that an optimum current flows in the corresponding contact position.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
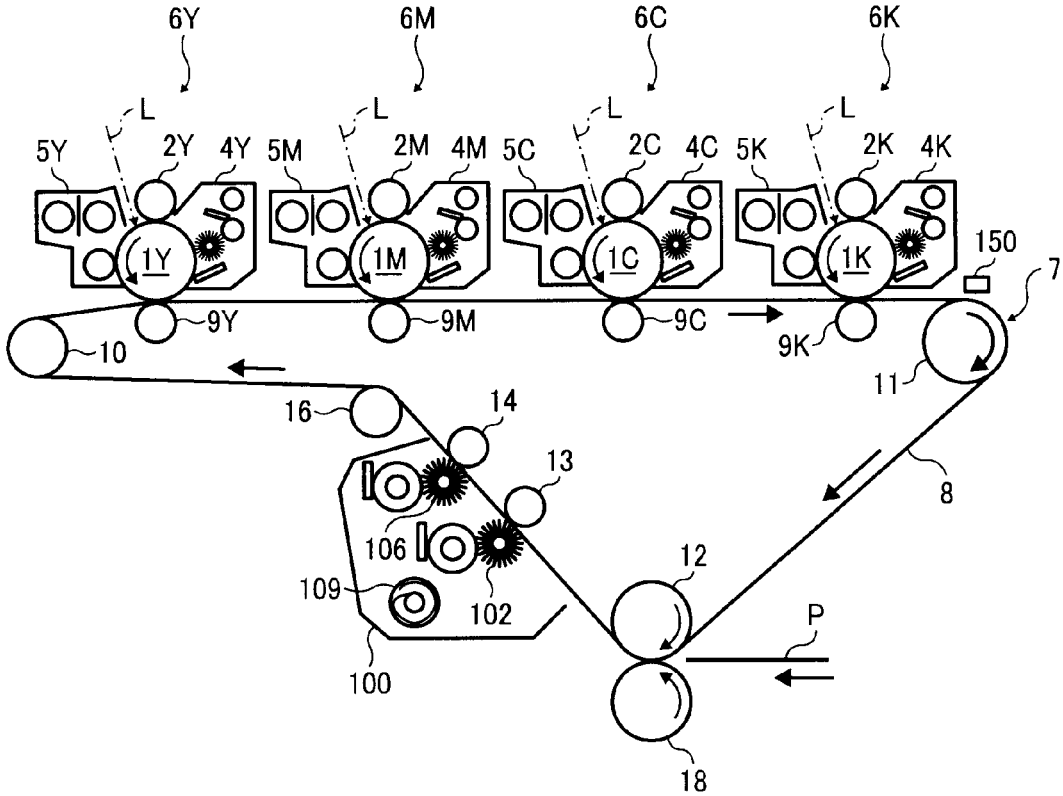
FIG. 1 is a schematic view illustrating an image forming apparatus according to exemplary embodiments of the invention.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result. For the sake of simplicity, the same reference number will be given to identical constituent elements such as parts and materials having the same functions and redundant descriptions thereof omitted unless otherwise stated.

FIG. 1 is a schematic view illustrating an image forming apparatus according to exemplary embodiments of the invention. The image forming apparatus is a printer employing a tandem intermediate transfer method. The printer includes four processing units 6Y, 6M, 6C, and 6K that form toner images of yellow, magenta, cyan, and black, respectively. The processing units 6Y, 6M, 6C, and 6K include drum-shaped photoreceptors 1Y, 1M, 1C, and 1K, respectively. Chargers 2Y, 2M, 2C, and 2K, developing devices 5Y, 5M, 5C, and 5K, cleaning devices 4Y, 4M, 4C, and 4K, and neutralizers are respectively provided around the photoreceptors 1Y, 1M, 1C, and 1K. The processing units 6Y, 6M, 6C, and 6K have the same configuration except for containing different-color toners of yellow, magenta, cyan, and black, respectively. An optical writing unit that emits laser light beams L to write electrostatic latent images on the photoreceptors 1Y, 1M, 1C, and 1K is disposed above the processing units 6Y, 6M, 6C, and 6K.

A transfer unit 7 is disposed below the processing units 6Y, 6M, 6C, and 6K. The transfer unit 7 includes a seamless intermediate transfer belt 8. The transfer unit 7 further includes multiple tension rollers provided inside the loop of the intermediate transfer belt 8, and a secondary transfer roller 18, a tension roller 16, and a belt cleaning device 100 each provided outside the loop of the intermediate transfer belt 8.

Inside the loop of the intermediate transfer belt 8, four primary transfer rollers 9Y, 9M, 9C, and 9K, a driven roller 10, a driving roller 11, a secondary transfer facing roller 12, and two cleaning facing rollers 13 and 14 are disposed. Each of these rollers is partially in contact with the intermediate transfer belt 8 and functions as a tension roller that stretches the intermediate transfer belt 8 taut. The cleaning facing rollers 13 and 14 do not necessarily have a function of stretching the intermediate transfer belt 8 and may be driven to rotate along with rotation of the intermediate transfer belt 8. The driving roller 11 is driven to rotate clockwise in FIG. 1 by a motor and the intermediate transfer belt 8 is further driven to endlessly move clockwise in FIG. 1 by the rotation of the driving roller 11.

The primary transfer rollers 9Y, 9M, 9C, and 9K and the photoreceptors 1Y, 1M, 1C, and 1K are sandwiching the intermediate transfer belt 8. Thus, primary transfer nips in which the photoreceptors 1Y, 1M, 1C, and 1K are contacting a peripheral surface of the intermediate transfer belt 8 are formed. The primary transfer rollers 9Y, 9M, 9C, and 9K are applied with a primary transfer bias having the opposite polarity to toner from a power source.

The secondary transfer facing roller 12 and the secondary transfer roller 18 is also sandwiching the intermediate transfer belt 8. Thus, a secondary transfer nip in which the secondary transfer roller 18 is contacting a peripheral surface of the intermediate transfer belt 8 is formed. The secondary transfer roller 18 is applied with a secondary transfer bias having the opposite polarity to toner from a power source. The secondary transfer roller 18 and the secondary transfer facing roller 12 may be also sandwiching a paper conveying belt, stretched across the secondary transfer roller 18 and several support and driving rollers, together with intermediate transfer belt 8.

The cleaning facing rollers 13 and 14 and cleaning brush rollers 102 and 106, provided in the belt cleaning device 100, are also sandwiching the intermediate transfer belt 8. Thus, cleaning nips in which the cleaning brush rollers 102 and 106 are contacting a peripheral surface of the intermediate transfer belt 8 are formed. The belt cleaning device 100 and the intermediate transfer belt 8 are integrally replaceable. Alternatively, the belt cleaning device 100 and the intermediate transfer belt 8 may be independently replaceable when their lifespans are different.

The printer further includes a paper feed part including a paper feed cassette that stores sheets of a recording medium P and paper feed rollers that feed the sheets to paper feed paths. A pair of registration rollers is disposed on the right side of the secondary transfer nip in FIG. 1. The pair of registration rollers receives the recording medium P from the paper feed part and feeds it toward the secondary transfer nip in synchronization with an entry of a toner image. A fixing device is disposed on the left side of the secondary transfer nip in FIG. 1. The fixing device receives the recording medium P having the toner image thereon from the secondary transfer nip and fixes the toner image on the recording medium P. The printer may optionally include toner supply devices that supply toners of yellow, magenta, cyan, and black to the respective developing devices 5Y, 5M, 5C, and 5K, if necessary.

In addition to normal paper, for example, a special paper having a concavo-convex surface or a paper used for thermal transfer such as iron print may be used for the recording medium P. It is likely that toner images on the intermediate transfer belt 8 are more defectively transferred onto such special papers than onto normal paper. To solve the problem of defective transfer, the intermediate transfer belt 8 has a low-hardness elastic layer that can even deform along poor-smoothness recording media or toner layers. The low-hardness elastic layer allows the intermediate transfer belt 8 to deform along surface roughness. Thus, the intermediate transfer belt 8 can intimately contact toner layers without applying excessive transfer pressure and can uniformly transfer the toner layer even onto a poor-smoothness recording medium.

The intermediate transfer belt 8 includes at least a base layer, the elastic layer, and a surface coating layer.

Specific preferred materials suitable for the elastic layer include, but are not limited to, elastic rubbers and elastomers, such as butyl rubber, fluorine-based rubber, acrylic rubber, EPDM, NBR, acrylonitrile-butadiene-styrene rubber, natural rubber, isoprene rubber, styrene-butadiene rubber, butadiene rubber, urethane rubber, syndiotactic 1,2-polybutadiene, epichlorohydrin rubber, polysulfide rubber, polynorbornene rubber, and thermoplastic elastomers (e.g., polystyrene type, polyolefin type, polyvinyl chloride type, polyurethane type, polyamide type, polyurea type, polyester type, fluorine-based resin type). Two or more of these materials can be used in combination.

The elastic layer preferably has a thickness of 0.07 to 0.6 mm, more preferably 0.25 to 0.6 mm. When the thickness is too small, the intermediate transfer belt 8 may apply excessive pressure to toner particles in the secondary transfer nip, thereby causing defective transfer.

The elastic layer preferably has a JIS-A hardness of 10° to 65°. Although it depends on its thickness, an intermediate transfer belt having too small a hardness may cause defective transfer. Also, it is difficult to stretch an intermediate transfer belt having too large a hardness across rollers. Also, such an intermediate transfer belt may require frequent replacements because it may be undesirably extended by exposure to a long-term stretch.

The base layer of the intermediate transfer belt 8 is comprised of a poorly-extendable resin. Specific preferred materials suitable for the base layer include, but are not limited to, polycarbonate, fluorine-based resins (e.g., ETFE, PVDF), styrene-based resins (i.e., homopolymers and copolymers of styrene or styrene derivatives) such as polystyrene, chloropolystyrene, poly-α-methylstyrene, styrene-butadiene copolymer, styrene-vinyl chloride copolymer, styrene-vinyl acetate copolymer, styrene-maleic acid copolymer, styrene-acrylate copolymers (e.g., styrene-methyl acrylate copolymer, styrene-ethyl acrylate copolymer, styrene-butyl acrylate copolymer, styrene-octyl acrylate copolymer, styrene-phenyl acrylate copolymer), and styrene-methacrylate copolymers (e.g., styrene-methyl methacrylate copolymer, styrene-ethyl methacrylate copolymer, styrene-phenyl methacrylate copolymer), methyl methacrylate resin, butyl methacrylate resin, ethyl acrylate resin, butyl acrylate resin, modified acrylic resins (e.g., silicone-modified acrylic resin, vinyl-chloride-modified acrylic resin, acrylic-urethane resin), vinyl chloride resin, styrene-vinyl acetate copolymer, vinyl chloride-vinyl acetate copolymer, rosin-modified maleic acid resin, phenol resin, epoxy resin, polyester resin, polyester polyurethane resin, polyethylene, polypropylene, polybutadiene, polyvinylidene chloride, ionomer resin, polyurethane resin, silicone resin, ketone resin, ethylene-ethyl acrylate copolymer, xylene resin, polyvinyl butyral resin, polyamide resin, and modified polyphenylene oxide resin. Two or more of these materials can be used in combination.

To prevent the elastic layer comprised of an extendable material (e.g., rubber) from being extended, a core material layer may be provided between the base layer and the elastic layer. Specific preferred materials suitable for the core material layer include, but are not limited to, natural fibers (e.g., cotton, silk), synthetic fibers (e.g., polyester fiber, nylon fiber, acrylic fiber, polyolefin fiber, polyvinyl alcohol fiber, polyvinyl chloride fiber, polyvinylidene chloride fiber, polyurethane fiber, polyacetal fiber, polyfluoroethylene fiber, phenol fiber), inorganic fibers (e.g., carbon fiber, glass fiber), and metal fibers (e.g., iron fiber, copper fiber). Two or more of these materials can be used in combination. These materials are used after being formed into yarn or woven cloth. The yarn may be comprised of either a single filament or multiple filaments twisted together, such as single twist yarn, plied yarn, and two folded yarn. Two or more of the above-described materials may be formed into blended yarn. The yarn may be subjected to conductive treatments. The woven cloth may be either stockinette or combined weave, and may be also subjected to conductive treatments.

The surface coating layer of the intermediate transfer belt 8 is a smooth layer that covers the surface of the elastic layer. The surface coating layer preferably includes a material which is poorly adhesive to toner so that the toner can be easily transferred from the intermediate transfer belt 8 onto a recording medium. For example, the surface coating layer may be comprised of one or more of polyurethane, polyester, or an epoxy resin, in which fine particles of one or more of lubricating materials such as fluorine-containing resins, fluorine-containing compounds, carbon fluoride, titanium oxide, and silicon carbide are dispersed. Such lubricating materials can reduce surface energy of the layer. The fine particles may have variety of particle diameters. The surface coating layer may also be a fluorine-containing layer formed by thermally treating a fluorine-containing rubber which can reduce surface energy of the layer.

Each of the base layer, elastic layer, and surface coating layer may include a resistivity controlling agent such as carbon black, graphite, a metal powder (e.g., aluminum, nickel), and a conductive metal oxide (e.g., tin oxide, titanium oxide, antimony oxide, indium oxide, potassium titanate, antimony-tin composite oxide (ATO)). The conductive metal oxides may be covered with an insulative fine particles such as barium sulfate, magnesium silicate, or calcium carbonate, for example.

Upon reception of image information from a personal computer, the driving roller 11 is rotationally driven to endlessly move the intermediate transfer belt 8. The tension rollers other than the driving roller 11 are rotationally driven as the intermediate transfer belt 8 moves. Simultaneously, the photoreceptors 1Y, 1M, 1C, and 1K are rotationally driven in the respective processing units 6Y, 6M, 6C, and 6K. The surfaces of the photoreceptors 1Y, 1M, 1C, and 1K are uniformly charged by the respective chargers 2Y, 2M, 2C, and 2K and then exposed to laser light beams L so that electrostatic latent images are formed on each photoreceptors 1Y, 1M, 1C, and 1K. The developing devices 5Y, 5M, 5C, and 5K develop the electrostatic latent images on the respective surfaces of the photoreceptors 1Y, 1M, 1C, and 1K into respective toner images of yellow, magenta, cyan, and black. The toner images of yellow, magenta, cyan, and black are sequentially transferred onto an outer peripheral surface of the intermediate transfer belt 8 in the respective primary transfer nips. Thus, a composite toner image in which the toner images of yellow, magenta, cyan, and black are superimposed on one another is formed on the outer peripheral surface of the intermediate transfer belt 8.

At the same time, in the paper feed part, the paper feed roller feeds a sheet of the recording medium P from the paper feed cassette toward the pair of registration rollers. The pair of registration rollers is rotationally driven to feed the recording medium P to the secondary transfer nip in synchronization with an entry of the composite toner image on the intermediate transfer belt 8 to the secondary transfer nip, so that the composite toner image is transferred onto the recording medium P from the intermediate transfer belt 8. Thus, the composite full-color toner image is formed on the recording medium P. The recording medium P having the full-color toner image thereon is then fed from the secondary transfer nip to the fixing device so that the full-color toner image is fixed on the recording medium P.

After the toner images of yellow, magenta, cyan, and black have been transferred from the photoreceptors 1Y, 1M, 1C, and 1K onto the intermediate transfer belt 8, the cleaning devices 4Y, 4M, 4C, and 4K remove residual toner particles remaining on the respective photoreceptors 1Y, 1M, 1C, and 1K without being transferred. The photoreceptors 1Y, 1M, 1C, and 1K are then neutralized with neutralization lamps and uniformly charged with the respective chargers 2Y, 2M, 2C, and 2K to be ready for the next image forming operation. After the composite toner image has been transferred from the intermediate transfer belt 8 onto the recording medium P, the belt cleaning device 100 removes residual toner particles remaining on the intermediate transfer belt 8 without being transferred.

Figure 2:
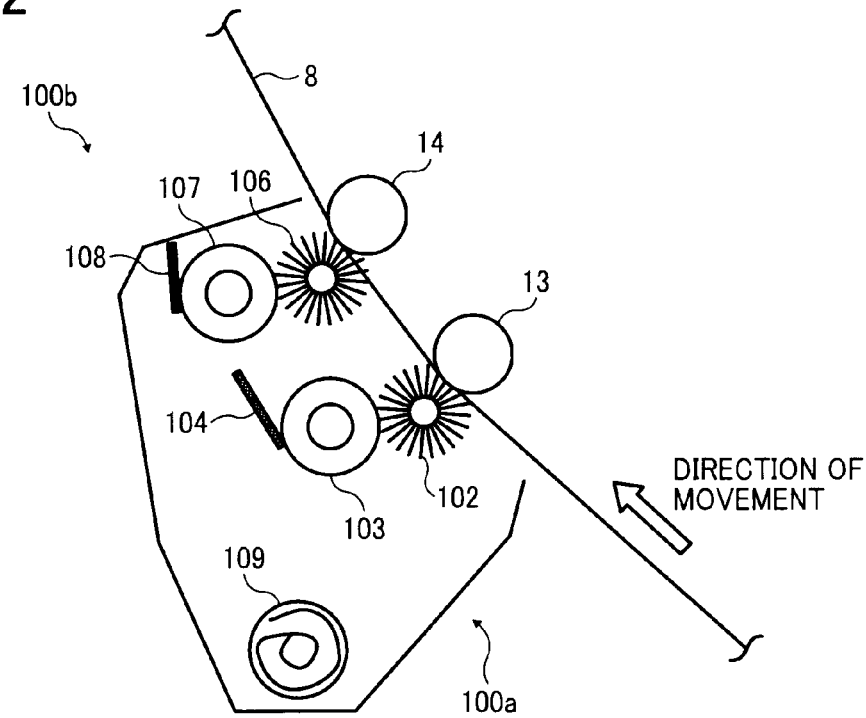
FIG. 2 is a magnified schematic view illustrating a belt cleaning device in the image forming apparatus illustrated in FIG. 1.

FIG. 2 is a magnified schematic view illustrating the belt cleaning device 100 in the image forming apparatus illustrated in FIG. 1. The belt cleaning device 100 includes a first cleaning part 100*a* that removes negatively-charged (i.e., normally-charged) toner particles and a second cleaning part 100*b* that removes positively-charged (i.e., oppositely-charged) toner particles from the intermediate transfer belt 8.

The first cleaning part 100*a* includes a first cleaning brush roller 102 serving as a voltage applying member, a first collecting roller 103 that collects toner particles adhered to the first cleaning brush roller 102, and a first scraping blade 104 that scrapes toner particles from the first collecting roller 103. The first cleaning brush roller 102 is comprised of a metallic rotary shaft pivotally supported and a brush roller comprised of multiple conductive fibers raised on the peripheral surface of the metallic rotary shaft.

The second cleaning part 100*b* is disposed downstream from the first cleaning part 100*a* relative to the direction of movement of the surface of the intermediate transfer belt 8. The second cleaning part 100*b* includes a second cleaning brush roller 106 serving as a voltage applying member, a second collecting roller 107, and a second scraping blade 108. The second cleaning brush roller 106 is comprised of a metallic rotary shaft pivotally supported and a brush roller comprised of multiple conductive fibers raised on the peripheral surface of the metallic rotary shaft.

The belt cleaning device 100 further includes a discharge screw 109 that discharges toner particles collected in the first and second cleaning parts 100*a* and 100*b* from the casing of the belt cleaning device 100. The toner particles discharged by the discharge screw 109 fall into a waste toner tank provided to the main body of the printer. Alternatively, the discharged toner particles may return to the developing device.

The second cleaning brush roller 106 may apply a lubricant to the surface of the intermediate transfer belt 8 to protect the surface of the intermediate transfer belt 8. In this case, a solid lubricant is brought into contact with the second cleaning brush roller 106. Additionally, a leveling blade that evens out the lubricant on the surface of the intermediate transfer belt 8 may be provided downstream from the second cleaning brush roller 106 relative to the direction of movement of the surface of the intermediate transfer belt 8. Alternatively, a lubricant application brush may be provided independently from the second cleaning brush roller 106. When the second cleaning brush roller 106 has both functions of collecting toner particles and applying a lubricant, the collected toner particles and the lubricant are mixed, and thus the collected toner particles are likely to return to the surface of the intermediate transfer belt 8 upon application of the lubricant thereto. Provision of the lubricant application brush can solve this disadvantage. Provision of the lubricant application brush can prevent the collected toner particles from adhering to the surface of the intermediate transfer belt 8 again.

Exemplary configurations of the belt cleaning device 100 are described below.

(Conditions of First Cleaning Brush Roller 102)

- Brush material: A conductive polyester having a core-sheath structure (the core being a conductive material and the sheath being a polyester)
- Brush resistance: $1\times10^{7}\Omega$ (measured at all areas in the axial direction under application of a voltage of 1,000 V)
- Brush length: 320 mm
- Contact nip width: 8 mm
- Brush density: 100,000 fibers/inch$^2$
- Brush fiber diameter: About 25 to 35 μm
- Brush diameter: 15 mm
- Brush intrusion to the intermediate transfer belt 8: 1 mm
- Brush revolution: 480 rpm
- Direction of rotation: To face the direction of movement of the intermediate transfer belt 8
- Fiber slanting treatment: Yes (Conditions of Second Cleaning Brush Roller 106)

- Brush material: A conductive polyester having a core-sheath structure (the core being a conductive material and the sheath being a polyester)
- Brush resistance: $1\times10^{7}\Omega$ (measured at all areas in the axial direction under application of a voltage of 1,000 V)
- Brush length: 320 mm
- Contact nip width: 8 mm
- Brush density: 100,000 fibers/inch$^2$
- Brush fiber diameter: About 25 to 35 μm
- Brush diameter: 15 mm
- Brush intrusion to the intermediate transfer belt 8: 1 mm
- Brush revolution: 480 rpm
- Direction of rotation: To face the direction of movement of the intermediate transfer belt 8
- Fiber slanting treatment: Yes The brush fibers of the first and second cleaning brush rollers 102 and 106 are conductive, but the surfaces thereof are covered with an insulative layer. The insulative layer allows only a small current to flow in the cleaning brush rollers 102 and 106 in contact with the intermediate transfer belt 8. Thus, an excessive current does not flow when the brush fibers electrostatically attract toner particles from the intermediate transfer belt 8. Therefore, it is unlikely that toner particles receive the opposite charge, thus preventing the collected toner particles from adhering to the intermediate transfer belt 8 again. The voltage applied to the rotary shafts is carefully controlled because the insulative layer may be destroyed by application of an ultrahigh voltage, which results in undesirable re-adhering of the toner particles to the intermediate transfer belt 8. The fiber configuration is not limited to the above-described embodiments and can be varied according to adjustment of the voltage. For example, the fibers may have a conductive layer on the insulative layer, or a conductive agent may be dispersed in the fibers.

The brush fibers implanted in the cleaning brush rollers 102 and 106 are preferably slanted to a certain direction so that the conductive agent exposed at cross sections of the fibers is prevented from contacting the intermediate transfer belt 8. Thus, charge injection to toner particles is suppressed and margin of cleanability is improved. The fiber may be, for example, an insulating material such as nylon, polyester, and an acrylic compound. Specific examples of usable fibers having a core-sheath structure include, but are not limited to, fibers described in Unexamined Japanese Patent Application Publication Nos. 10-310974, 10-131035, 01-292116, 01-213411, 01-183520, and 63-219624, the disclosures thereof being incorporated herein by reference.

(Conditions of First Collecting Roller 103)

- Cored material: SUS
- Roller diameter: 14 mm
- Brush fiber intrusion to the first collecting roller 103: 1.5 mm
- Roller revolution: 480 rpm
- Direction of rotation: To face the direction of rotation of the first cleaning brush roller 102

(Conditions of Second Collecting Roller 107)

- Cored material: SUS
- Roller diameter: 14 mm
- Brush fiber intrusion to the second collecting roller 107: 1.5 mm
- Roller revolution: 480 rpm
- Direction of rotation: To face the direction of rotation of the second cleaning brush roller 106

In the present embodiment, the collecting rollers 103 and 107 are comprised of SUS. Alternatively, each of the collecting rollers 103 and 107 may be a conductive roller comprised of another material, a roller covered with an elastic tube having a thickness of about several μm to 100 μm, or a roller having a coating layer, for example. The surfaces of the collecting rollers 103 and 107 may be formed from, for example, a PVDF tube, a PFA tube, an acrylic coating, a silicone coating (e.g., a polycarbonate coating including silicone particles), a ceramics coating, or a fluorine coating.

(Conditions of First Scraping Blade 104)

- Material: SUS
- Thickness: 100 μm
- Blade contacting angle: 20°
- Blade intrusion to the first collecting roller 103: 0.6 mm (Conditions of Second Scraping Blade 108)

- Material: SUS
- Thickness: 100 μm
- Blade contacting angle: 20°
- Blade intrusion to the second collecting roller 107: 0.6 mm (Conditions of Intermediate Transfer Belt 8)

- Material: Elastic belt
- Layer thickness: 560 μm
- Volume resistivity: $1.91\times10^{10}\ \Omega\cdot$cm (when a voltage of 100 V is applied)
- Surface resistivity: $1.70\times10^{11}\Omega/\square$ (when a voltage of 500 V is applied)
- Surface movement speed: 350 mm/s (Conditions of Cleaning Facing Rollers 13 and 14)

- Material: Aluminum
- Diameter: 14 mm

The resistance values of the cleaning brush rollers 102 and 106 and the intermediate transfer belt 8 are not limited to the above-described exemplary values. In the present embodiment, to be described later, the voltage applied to the cleaning brush rollers 102 and 106 is controlled in normal operation so that an optimum amount of current flows. Therefore, resistance values of the cleaning brush rollers 102 and 106 are also variable within a wider range compared to a case in which a constant voltage is applied to the cleaning brush rollers 102 and 106. For example, when the cleaning brush rollers 102 and 106 have a resistance of $1\times10^{5.5}\Omega$ to $1\times10^{10}\Omega$ and the intermediate transfer belt 8 has a volume resistivity of $1\times10^{8}$ $\Omega\cdot$cm to $1\times10^{13}$ $\Omega\cdot$cm and a surface resistivity of $1\times10^{8}\Omega/\square$ to $1\times10^{14}\Omega/\square$, an optimum amount of current reliably flows while controlling the voltage applied to the cleaning brush rollers 102 and 106.

Figure 3:
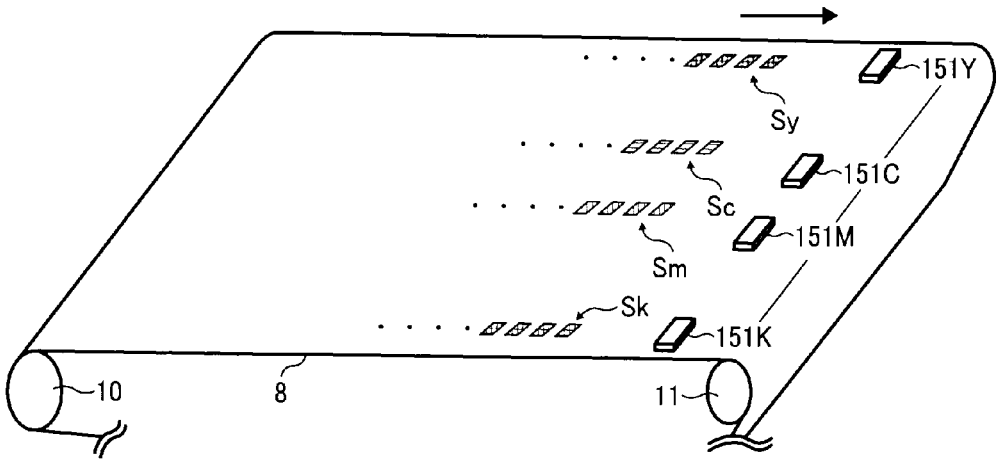
FIG. 3 is a magnified schematic view illustrating an optical sensor unit and an intermediate transfer belt in the image forming apparatus illustrated in FIG. 1.

Referring back to FIG. 1, an optical sensor unit 150 is disposed on the right side of the processing unit 6K while facing an outer peripheral surface of the intermediate transfer belt 8 forming a predetermined gap therebetween. FIG. 3 is a magnified schematic view illustrating the optical sensor unit 150 and the intermediate transfer belt 8. The optical sensor unit 150 includes a yellow optical sensor 151Y, a cyan optical sensor 151C, a magenta optical sensor 151M, and a black optical sensor 151K arranged in the width direction of the intermediate transfer belt 8. Each of these sensors is a reflective photosensor in which a light-emitting element emits light to an outer peripheral surface of the intermediate transfer belt 8 or a toner image thereon and a light-receiving element detects the reflected light. A controller detects a toner image on the intermediate transfer belt 8 and its image density (i.e., the amount of toner per unit area) based on the output voltage from the above sensors.

Upon application of power or at every predetermined printing operation, the printer may be subject to process control to set the printer in a proper condition. Specifically, each device in the printer is subject to operation check and operation setting, and is controlled to maintain an original image quality referring to the optical detection results of the produced image. The process control includes, for example, image density control and color deviation correction.

In the image density control, as shown in FIG. 3, gradation patterns Sk, Sm, Sc, and Sy are automatically formed on the intermediate transfer belt 8 at the positions facing the optical sensors 151K, 151M, 151C, and 151K, respectively. Each gradation pattern comprises ten toner patches each having a different image density and an area of 2 cm×1 cm. When forming the gradation patterns Sk, Sm, Sc, and Sy, the surface potentials of the photoreceptors 1Y, 1M, 1C, and 1K are gradually increased, in contrast to the normal printing process in which the surface potentials are kept constant. Specifically, multiple electrostatic latent patches are formed on the photoreceptors 1Y, 1M, 1C, and 1K by laser light scanning and then developed into toner patches by the developing devices 5Y, 5M, 5C, and 5K, respectively. When developing the electrostatic latent patches into toner patches, the developing bias applied to the developing rollers are gradually increased. As a result, gradation patterns of yellow, magenta, cyan, and black are formed on the respective photoreceptors 1Y, 1M, 1C, and 1K. The gradation patterns are then primarily transferred onto the intermediate transfer belt 8 at a predetermined interval in the main scanning direction. Each toner patch includes the toner in an amount of 0.1 mg/cm$^2$ to 0.55 mg/cm$^2$. In each toner patch, toner particles substantially have normal polarity.

The gradation patterns Sk, Sm, Sc, and Sy pass the positions facing the respective optical sensors 151K, 151M, 151C, and 151K as the intermediate transfer belt 8 endlessly moves. The optical sensors 151K, 151M, 151C, and 151K receive light in an amount corresponding to the toner amount per unit area in each toner patch. Thus, the toner amount in each toner patch is calculated from the output voltage from the optical sensor 151K, 151M, 151C, or 151K and a conversion algorithm. Imaging conditions are adjusted based on the calculated toner amounts. More specifically, the toner amounts in toner patches detected by the optical sensors and the developing potentials at developing the toner patches are compiled and subjected to a linear regression analysis to define a function (y=ax+b). The optimum developing bias is obtained by substituting a desired image density into the function.

A memory is storing an imaging condition data table correlating several tens of developing bias values with their optimum charge potentials of the photoreceptors. Each of the processing units 6Y, 6M, 6C, and 6K selects a developing bias value closest to an actual developing bias from the imaging condition data table to determine the optimum charge potential of each photoreceptor.

Figure 4:
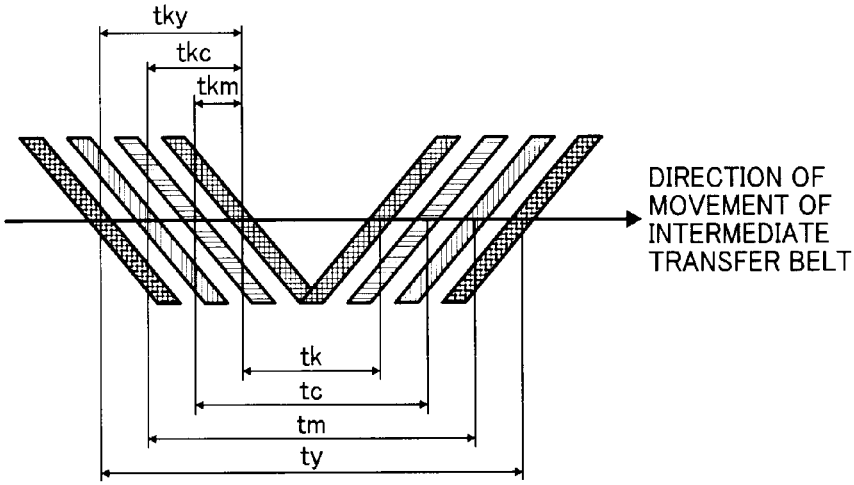
FIG. 4 illustrates a single set of the Chevron patch formed on the intermediate transfer belt.

In the color deviation correction, a color deviation detecting image, i.e., a Chevron patch as illustrated in FIG. 4, is formed on both ends of the intermediate transfer belt 8 in the width direction. The Chevron patch is comprised of linear toner images of yellow, magenta, cyan, and black each slanted about 45° relative to the main scanning direction and arranged at a predetermined interval in the direction of movement of the intermediate transfer belt 8 (i.e., the sub-scanning direction). FIG. 4 illustrates a single set of the Chevron patch. Multiple sets of the Chevron patch are continuously formed on both ends. The Chevron patch includes toner in an amount of 0.3 mg/cm$^2$.

Upon detection of the toner images in the Chevron patches on both ends of the intermediate transfer belt 8 in the width direction, the position in the main scanning direction (i.e., the axial direction of the photoreceptor), the position in the sub-scanning direction (i.e., the direction of movement of the intermediate transfer belt 8), the magnification error in the main scanning direction, and the skew from the main scanning direction are detected with respect to each of the toner images. The main scanning direction is coincident with a direction in which a laser light beam changes its phase on the photoreceptor upon reflection by a polygon mirror. The detection time differences tky, tkm, and tkc between detecting the black toner image and detecting the yellow, magenta, and cyan toner images, respectively, in the Chevron patch, are determined from the optical sensors 151. In FIG. 4, the main scanning direction is coincident with the vertical direction. In the Chevron patch, a set of toner images of yellow, magenta, cyan, and black aligned in this order from the left and another set of toner images of black, cyan, magenta, and yellow aligned in this order from the left, slanted 90° from the former set of toner images, are arranged side by side. The deviation amount in the sub-scanning direction, i.e., the amount of registration deviation, with respect to each of the toner images is determined based on the differences between the actual and ideal values of the detection time differences tky, tkm, and tkc. The timing for optically writing an image on the photoreceptor 1 is adjusted with respect to every face of the polygon mirror, i.e., per scanning line pitch, based on the amount of registration deviation, so that registration deviation is suppressed. The skew from the main scanning direction with respect to each of the toner images is determined based on the difference in deviation amount in the sub-scanning direction between both ends of the intermediate transfer belt 8. Optical face tangle error correction is conducted based on the measured skew so that skew deviation is suppressed. In summary, in the color deviation correction, the timings of optical writing and optical face tangle error are corrected based on the detection times of the toner images in the Chevron patch, so that registration and skew deviations are suppressed. Even when the positions on the intermediate transfer belt 8 at which toner images are formed are temporarily deviated due to temperature change, color deviation is suppressed by the above-described color deviation correction.

Toner images formed in the image density control or color deviation correction should be removed by the belt cleaning device 100 without being transferred onto a recording medium. Therefore, operation conditions (e.g., a voltage to be applied) of the belt cleaning device 100 is preferably set in the initial stage of the process control or at least before the image density control and color deviation correction, in a case in which the belt cleaning device 100 is subject to the process control.

The belt cleaning device 100 removes either the above-described toner images formed in the image density control or color deviation correction, or residual toner particles remaining on the intermediate transfer belt 8 without being transferred onto the recording medium P in the normal image forming operations. When a low-image-area image is continuously produced, spent toner particles are gradually increased and accumulate in the developing device. Such spent toner particles are poor in chargeability. Such spent toner particles are also poor in developability and transferability, resulting in poor-quality image. To solve this problem, the printer can execute a refresh mode in which spent toner particles are forcibly discharged from the developing devices to non-image areas on the photoreceptors 1Y, 1M, 1C, and 1K at regular intervals and fresh toner particles are supplied to the developing devices. Toner particles discharged in the refresh mode are also removed by the belt cleaning device 100 without being transferred.

Figure 5:
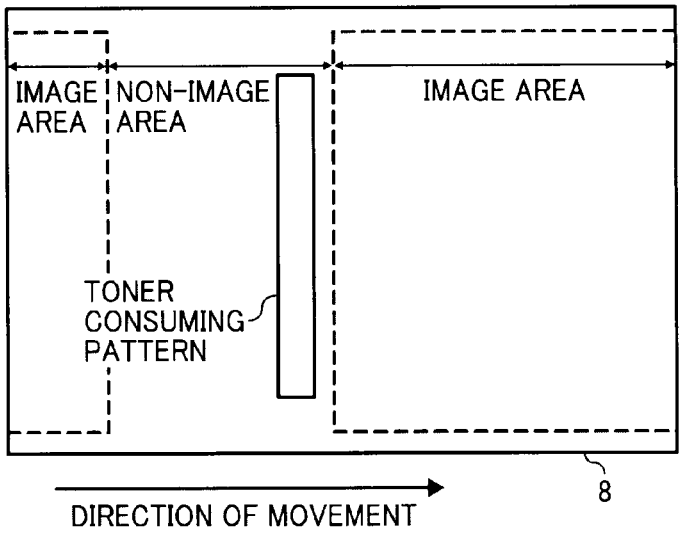
FIG. 5 illustrates a toner consuming pattern formed on the intermediate transfer belt.

A control part stores data regarding toner consumption and operation time in the developing devices 5Y, 5M, 5C, and 5K. Thus, the control part checks at a predetermined timing whether toner consumption within a predetermined operation time period is subthreshold or not in each of the developing devices 5Y, 5M, 5C, and 5K, and then executes the refresh mode only in the developing devices in which the toner consumption is subthreshold. In the refresh mode, a toner consuming pattern having a rectangular shape of 250 mm×30 mm is formed on a non-image area, corresponding to the interval between paper sheets, on each photoreceptor, according to the toner consumption per unit operation time. The toner consuming patterns of each color are transferred onto the intermediate transfer belt 8 and superimposed on one another, as illustrated in FIG. 5. The amount of toner in the toner consuming pattern is determined based on the toner consumption per unit operation time. The maximum amount of toner may be about 1.0 mg/cm$^2$. In the toner consuming pattern having been transferred onto the intermediate transfer belt 8, toner particles substantially have normal polarity.

The amount of toner to be input into the belt cleaning device 100 varies widely, from 0.05 mg/cm$^2$ to 1.0 mg/cm$^2$. The amount of cleaning current that flows in the contact portions of the cleaning brush roller 102 or 106 with the intermediate transfer belt 8 is optimized so that the belt cleaning device 100 produces the best performance. The optimum amount of cleaning current depends on the amount of toner input into the belt cleaning device 100. The greater the toner input, the greater the optimum amount of cleaning current. The smaller the toner input, the smaller the optimum amount of cleaning current.

Figure 6:
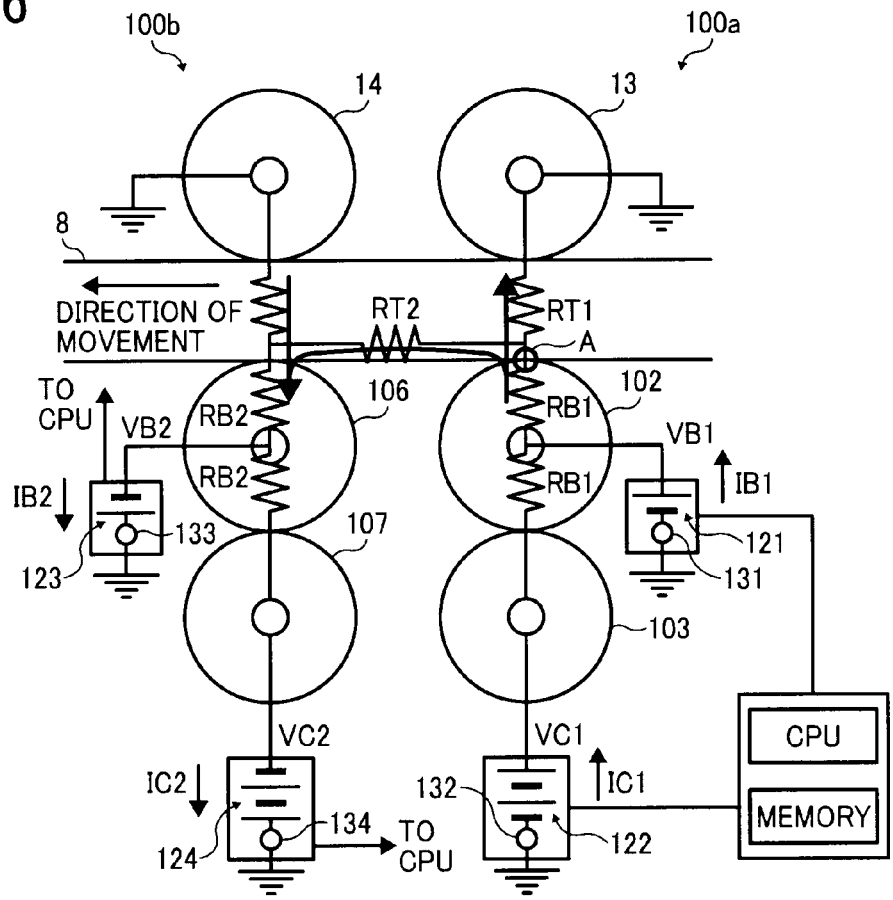
FIG. 6 is a schematic view illustrating an equivalent circuit regarding cleaning current in the belt cleaning device.

FIG. 6 is a schematic view illustrating an equivalent circuit regarding cleaning current in the belt cleaning device 100. A cleaning current flows in an area where toner particles migrate from the intermediate transfer belt 8 to the cleaning brush roller 102 or 106. For example, in the first cleaning part 100*a* illustrated in FIG. 6, a cleaning current flows in a point A where the cleaning brush roller 102 contacts the intermediate transfer belt 8. The cleaning current value is a sum of current values IB1 and IC1 each detected by current sensors 131 and 132 in power sources 121 and 122, respectively. The power sources 121 and 122 apply a voltage to the first cleaning brush roller 102 and the first collecting roller 103, respectively. Similarly, in the second cleaning part 100*b* illustrated in FIG. 6, the cleaning current value is a sum of current values IB2 and IC2 each detected by current sensors 133 and 134 in power sources 123 and 124, respectively. The power sources 123 and 124 apply a voltage to the second cleaning brush roller 106 and the second collecting roller 107, respectively. The current sensors 131 to 134 may be provided either on the grounded side or the high-voltage side relative to the respective power sources 121 to 124. The current sensors on the grounded side are not necessarily resistant to pressure. The current sensors on the high-voltage side are resistant to noise.

Table 1 shows an example of a setting table for obtaining an optimum current value in the cleaning parts 100*a* and 100*b* in the belt cleaning device 100.

TABLE 1

| Environmental conditions | Cleaning parts | Optimum current values IB + IC (μm) Normal speed mode | Half speed mode |
|---|---|---|---|
| LL (low temperature and low humidity) | First cleaning part 100a (for untransferred toner particles) | 76 | 38 |
| | First cleaning part 100a (for residual toner particles) | 37 | 19 |
| | Second cleaning part 100b | −23 | −12 |
| MM (normal temperature and normal humidity) | First cleaning part 100a (for untransferred toner particles) | 65 | 33 |
| | First cleaning part 100a (for residual toner particles) | 20 | 10 |
| | Second cleaning part 100b | −25 | −13 |
| HH (high temperature and high humidity) | First cleaning part 100a (for untransferred toner particles) | 42 | 21 |
| | First cleaning part 100a (for residual toner particles) | 18 | 9 |
| | Second cleaning part 100b | −30 | −15 |

The first cleaning part 100*a* removes most of normally-charged toner particles input in the belt cleaning device 100 ranged in an amount of 0.05 mg/cm$^2$ to 1.0 mg/cm$^2$. To respond to such wide range of input toner quantity, the first cleaning part 100*a* has two optimum current values. One is for removing a large amount of normally-charged untransferred toner particles, which are not to be transferred, in the process control or refresh mode, and the other is for removing a small amount of residual toner particles, which have not been transferred in normal image forming operations, in normal image forming operations. Optimum current values may be more finely divided according to the degree of input toner quantity.

The second cleaning part 100*b* removes a relatively small amount of oppositely-charged toner particles not removed in the first cleaning part 100*a*. Thus, input toner quantity narrowly ranges. Therefore, the second cleaning part 100*b* has only one optimum current value.

The optimum current value for producing the best performance of the belt cleaning device 100 depends on temperature and humidity. Therefore, different optimum current values are set according to a variety of environmental conditions, such as a high-temperature and high-humidity condition, a normal-temperature and normal-humidity condition, and a low-temperature and low-humidity condition.

To change the voltage to be applied to the belt cleaning device 100, first, a CPU selects the optimum current value from the setting table shown in Table 1 stored in a memory based on the temperature and humidity detected by a temperature-humidity sensor provided in the printer. The voltage to be applied to the belt cleaning device 100 is changed not only at the time of the process control, performed upon application of power or at every predetermined printing operation, but also at the time when the difference in temperature or humidity between the latest and the last occasions for changing the voltage exceeds a predetermined value. For example, the temperature change is 10° C. or more or the humidity change is 50% or more, the voltage to be applied is changed with reference to the setting table so that the optimum current value is also changed according to the current temperature or humidity condition. In the present embodiment, temperature and humidity conditions are roughly divided into three conditions as shown in Table 1. Temperature and humidity conditions may be more finely divided according to the degree of temperature and humidity.

The voltage to be applied to the belt cleaning device 100 is changed as follows. The power sources 121, 122, 123, and 124 apply each predetermined voltage to the first cleaning brush roller 102, the first collecting roller 103, the second cleaning brush roller 106, and the second collecting roller 107, respectively, while the intermediate transfer belt 8 and the belt cleaning device 100 are driven without toner input to the belt cleaning device 100. For example, to change the voltage to be applied to the first cleaning brush roller 102, a current value flowing in the contact point of the first cleaning brush roller 102 with the intermediate transfer belt 8 is detected. More specifically, the current values IB1 and IC1 flowing in the respective power sources 121 and 122 are detected. The voltage to be applied to the first cleaning brush roller 102 is specified so that the sum of the current values IB1 and IC1 becomes the optimum current value. Thus, the specified voltage is applied to the first cleaning brush roller 102 in succeeding normal operations.

When the voltage to be applied to the first cleaning brush roller 102 is changed, the first collecting roller 103 is applied with a voltage adjusted so that the potential difference between the first cleaning brush roller 102 and the first collecting roller 103 is kept constant (e.g., 400 V). When the voltage to be applied to the first cleaning brush roller 102 is changed, the second cleaning brush roller 106 is applied with its set voltage. Alternatively, when the voltage to be applied to the first cleaning brush roller 102 is changed, the second cleaning brush roller 106 may be applied with a voltage different from its set voltage. However, it is more preferable that the second cleaning brush roller 106 is applied with its set voltage, and at least applied with a voltage having the same polarity as its set voltage. When the voltage to be applied to the first cleaning brush roller 102 is changed, the second collecting roller 107 is applied with a voltage adjusted so that the potential difference between the second collecting roller 107 and the second cleaning brush roller 106 is kept constant (e.g., 400 V).

The potential differences between the cleaning brush rollers 102 and 106 and the respective collecting rollers 103 and 107 may be set constant because cleaning performance is less sensitive to the potential difference. Since cleaning performance does not vary when the potential difference ranges between 0 to 800 V, the potential difference is set to 400 V in the present embodiment. The reason for the less sensitivity may be considered that the collecting rollers can keep the potential constant because of being conductive in contrast to the cleaning brush rollers and intermediate transfer belt having a low resistance. The current values IB and IC may have an independent optimum value and may be independently adjusted. However, because the adjustment procedures are complicated and the difference between IB and IC is less sensitive to cleaning performance, the potential difference between the cleaning brush roller and the collecting roller is set constant and the optimum current value is set to the sum of IB and IC in the present embodiment.

The printer has a half speed mode in which the photoreceptor and the intermediate transfer belt are driven at a linear speed of 175 mm/s, which is half the normal linear speed of 350 mm/s, so as to accept various types of recording media such as thick paper. As shown in Table 1, the optimum current values in the half speed mode are half those in the normal speed mode. The optimum current values are roughly proportional to the linear speed. Therefore, the optimum current value can be arbitrarily set according to the linear speed. For example, when the linear speed is 700 m/s, which is twice the normal linear speed of 350 mm/s, the optimum current value is twice that at the normal linear speed of 350 mm/s.

In printers having a normal speed mode, a half speed mode, and any other mode, the voltage to be applied to the belt cleaning device 100 may be changed upon application of power or at the process control so that the optimum amount of current flows in every mode. In the present embodiment, however, the voltage is changed for only one mode so that the optimum amount of current flows only in the only one mode. For example, the voltage to be applied is changed so that the optimum amount of current flows only in the normal speed mode that is most frequently used, thereby shortening the processing time as well as standby time.

With respect to the other modes for which the voltage to be applied has not been changed, the voltage may be changed within a time period which does not cause standby time, for example, after a printing operation and before an input of the next printing command. With respect to a mode which is less frequently used, the voltage to be applied may be changed at the time a printing command is input in that mode. A timing of changing the voltage to be applied is determined depending on printer usage so that standby time is shortened according to the printer usage.

The printer gets ready for printing after the voltage to be applied to the belt cleaning device 100 has been changed and image control has been terminated. In the normal image forming operation, residual toner particles remaining on the intermediate transfer belt 8 are conveyed from the secondary transfer nip to a position facing the first cleaning brush roller 102 as the intermediate transfer belt 8 rotates. The first cleaning brush roller 102 is applied with a constant voltage so that the predetermined optimum amount of cleaning current having the opposite polarity to the toner (i.e., positive polarity) flows. The negatively-charged residual toner particles on the intermediate transfer belt 8 are electrostatically attracted to the first cleaning brush roller 102 by the action of an electric field formed between the intermediate transfer belt 8 and the first cleaning brush roller 102 due to the surface potential difference therebetween relative to the first cleaning facing roller 13 that is grounded. The negatively-charged toner particles on the first cleaning brush roller 102 are then conveyed to the contact position with the first collecting roller 103. The first collecting roller 103 is applied with a positive voltage, the absolute value of which is greater than that applied to the first cleaning brush roller 102, so that the potential difference between the first cleaning brush roller 102 and the first collecting roller 103 becomes 400 V. Thus, the negatively-charged toner particles on the first cleaning brush roller 102 are electrostatically attracted to the first collecting roller 103 by the action of an electric field formed between the first cleaning brush roller 102 and the first collecting roller 103 due to the surface potential difference therebetween. The toner particles are scraped off from the first collecting roller 103 by the first scraping blade 104. The toner particles scraped off by the first scraping blade 104 are then discharged from the printer by the discharge screw 109.

Positively-charged residual toner particles remaining on the intermediate transfer belt 8 which are not removed by the first cleaning brush roller 102 are conveyed to a position facing the second cleaning brush roller 106. The second cleaning brush roller 106 is applied with a constant voltage so that the predetermined optimum amount of cleaning current having the same polarity as the toner (i.e., negative polarity) flows. The positively-charged residual toner particles on the intermediate transfer belt 8 are electrostatically attracted to the second cleaning brush roller 106 by the action of an electric field formed between the intermediate transfer belt 8 and the second cleaning brush roller 106 due to the surface potential difference therebetween relative to the second cleaning facing roller 14 that is grounded. The positively-charged toner particles on the second cleaning brush roller 106 are then conveyed to the contact position with the second collecting roller 107. The second collecting roller 107 is applied with a negative voltage, the absolute value of which is greater than that applied to the second cleaning brush roller 106, so that the potential difference between the second cleaning brush roller 106 and the second collecting roller 107 becomes 400 V. Thus, the positively-charged toner particles on the second cleaning brush roller 106 are electrostatically attracted to the second collecting roller 107 by the action of an electric field formed between the second cleaning brush roller 106 and the second collecting roller 107 due to the surface potential difference therebetween. The toner particles are scraped off from the second collecting roller 107 by the second scraping blade 108. The toner particles scraped off by the second scraping blade 108 are then discharged from the printer by the discharge screw 109.

The gradation patterns, Chevron patches, and toner consuming patterns on the intermediate transfer belt 8 that are not transferred are also collected by the belt cleaning device 100. A voltage applied to the first cleaning part 100*a* is switched from the predetermined value set for removing residual toner particles in the regular image forming operation to a specific value set for removing the above patterns, upon entry of the above patterns into the belt cleaning device 100.

Table 2 shows examples of set voltages to be applied to the belt cleaning device 100.

TABLE 2

| VB1/VB2 | Image quality | IB1 + IC1 (μA) | IB2 + IC2 (μA) |
|---|---|---|---|
| 5100 V/−1900 V | Good | 68.3 | −16.9 |
| 5000 V/−2400 V | Good | 69.1 | −28.7 |
| 5800 V/−1700 V | Good | 85.9 | −17.6 |
| 5700 V/−2000 V | Good | 89.5 | −28.2 |

Referring to Table 1, the optimum current value for removing untransferred toner particles in the low-temperature and low-humidity condition (10° C., 15% RH) is set to 76 μA in the first cleaning part 100*a* and −23 μA in the second cleaning part 100*b*. Whether removal of toner particles (hereinafter "cleaning") is defective or not when the actual current values are deviated from the optimum current values is determined in consideration of tolerance of power source output and any other noise. For example, when a voltage of 5,100 V is applied to the first cleaning brush roller 102, a voltage of 5,500 V is applied to the first collecting roller 103, a voltage of −1,900 V is applied to second cleaning brush roller 106, and a voltage of −2,300 V is applied to the second collecting roller 107, a current (i.e., IB1+IC1) flowing in the first cleaning part 100*a* is 68.3 μA and a current (i.e., IB2+IC2 ) flowing in the second cleaning part 100*b* is −16.9 μA. In this case, the cleaning is found not to be defective because the resulting image quality is good. Table 2 shows other examples in which the cleaning is not defective even when the actual current values are deviated from the optimum current values. It is clear from Table 2 that the cleaning is not defective when the deviation of the actual current value from the optimum current value is within about ±10%.

In removing untransferred toner particles in the low-temperature and low-humidity condition (10° C., 15% RH), when a voltage of 5,400 V is applied to the first cleaning brush roller 102, a voltage of 5,800 V is applied to the first collecting roller 103, a voltage of −2,200 V is applied to second cleaning brush roller 106, and a voltage of −2,600 V is applied to the second collecting roller 107, the optimum amount of current flows in both the first cleaning part 100*a* and the second cleaning part 100*b*.

Table 3 shows comparative examples in which the voltage to be applied to the first cleaning part 100*a* and the voltage to be applied to the second cleaning part 100*b* are independently changed. In other words, Table 3 shows comparative examples in which the voltage to be applied to one of the cleaning parts is changed while no voltage is applied to the other.

TABLE 3

| VB1/VB2 | Image quality | IB1 + IC1 (μA) | IB2 + IC2 (μA) |
|---|---|---|---|
| 5400 V/−3100 V | Average | 84.6 | −50.2 |
| 5400 V/−3600 V | Average | 97.1 | −73.8 |
| 6200 V/−3100 V | Average | 120.3 | −71.5 |
| 4200 V/−3600 V | Poor | 369.0 | −332.0 |

In removing untransferred toner particles in the low-temperature and low-humidity condition (10° C., 15% RH), the voltages that can flow the optimum amount of current (i.e., 76 μA) in the first cleaning part 100*a*, i.e., a voltage of 5,400 V and a voltage of 5,800 V, are applied to the first cleaning brush roller 102 and the first collecting roller 103, respectively, while the power sources in the second cleaning part 100*b* are kept off. In this case, a current (i.e., IB1+IC1) flowing in the first cleaning part 100*a* is 69.2 μA, which is smaller than the optimum current value of 76 μA. In removing untransferred toner particles in the low-temperature and low-humidity condition (10° C., 15% RH), the voltages that can flow the optimum amount of current (i.e., −23 μA) in the second cleaning part 100*b*, i.e., a voltage of −3,100 V and a voltage of −3,500 V, are applied to the second cleaning brush roller 106 and the second collecting roller 107, respectively, while the power sources in the first cleaning part 100*a* are kept off. In this case, a current (i.e., IB2+IC2) flowing in the second cleaning part 100*b* is −19.1 μA, which is greater than the optimum current value of −23 μA.

However, when the above-set voltages are applied to the cleaning parts 100*a* and 100*b* in normal operation, a current (i.e., IB1+IC1) flowing in the first cleaning part 100*a* becomes 84.6 μA and a current (i.e., IB2+IC2) flowing in the second cleaning part 100*b* becomes−50.2 μA, each of which are considerably deviated from the optimum current value. The reason for this may be considered as follows. In changing the voltage to be applied to the first cleaning part 100*a*, most of the current flowing in the first collecting roller 103 and the first cleaning brush roller 102 further flows into the intermediate transfer belt 8 in the thickness direction and further into the first cleaning facing roller 13. The potential at the second contact portion in the second cleaning part 100*b*, where the second cleaning brush roller 106 contacts the intermediate transfer belt 8, is about 0 V in changing the voltage to be applied to the first cleaning part 100*a*. By contrast, in normal operation, the potential at the second contact portion is considerably reduced to a negative potential. Thus, the potential at the first contact portion in the first cleaning part 100*a*, where the first cleaning brush roller 102 contacts the intermediate transfer belt 8, is reduced due to the negative potential at the second contact portion. As a result, a current (i.e., IB1+IC1) flowing in the first cleaning part 100*a* becomes greater than the optimum current value. The same goes for the second cleaning part 100*b*.

Figure 7:
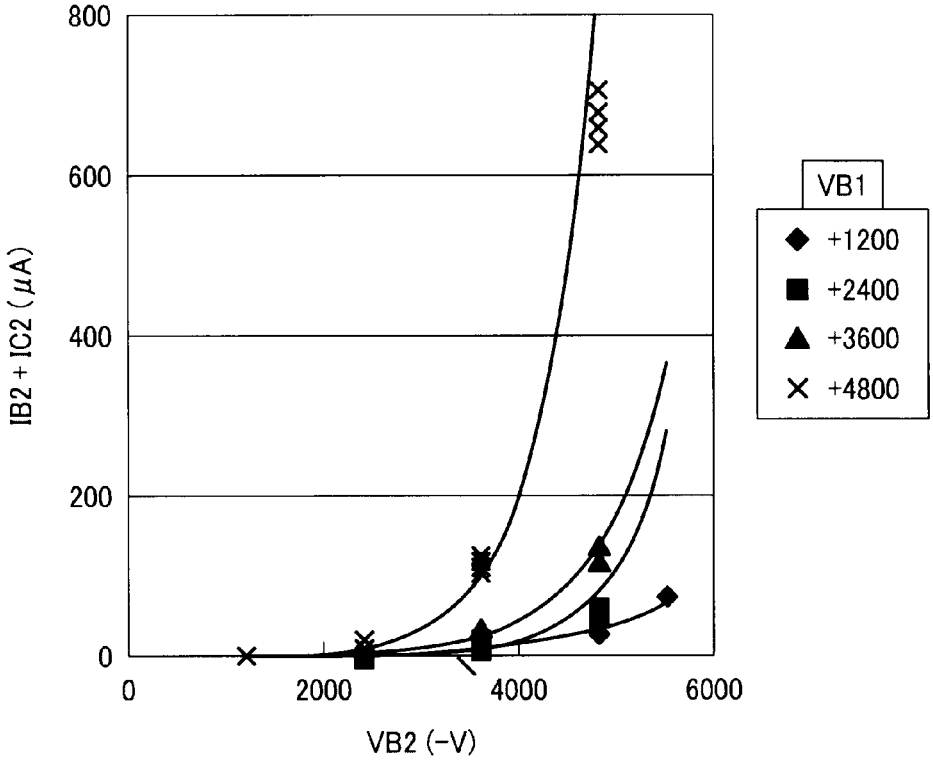
FIG. 7 is a graph showing a relation between voltage and current in the belt cleaning device.

FIG. 7 is a graph showing a relation between voltages VB2 and VC2 applied to the second cleaning part 100*b* and a current (i.e., IB2+IC2) flows in the second cleaning part 100*b*, when a voltage VB1 applied to the first cleaning part 100*a* is changed. The potential difference between the voltage VC2 applied to the second collecting roller 107 and the voltage VB2 applied to the second cleaning brush roller 106 is fixed to 400 V. As shown in FIG. 7, the current (i.e., IB2+IC2) flowing in the second cleaning part 100*b* is influenced by not only the voltages VB2 and VC2 applied to the second cleaning part 100*b* but also the voltage VB1 applied to the first cleaning part 100*a*. In particular, when the potential difference between the first cleaning brush roller 102 in the first cleaning part 100*a* and the second cleaning brush roller 106 in the second cleaning part 100*b* is 6,000 V or more, more preferably 7,000 V or more, the current (i.e., IB2+IC2) flowing in the second cleaning part 100*b* is drastically increased, resulting in rapid current flow from the first cleaning part 100*a* into the second cleaning part 100*b*.

The current flowing from the first collecting roller 103 and the first cleaning brush roller 102 splits into a first current path that flows into the first cleaning facing roller 13 via the inside of the intermediate transfer belt 8 and a second current path that flows into the second cleaning brush roller 106 via the surface of the intermediate transfer belt 8. The first current path has a resistance R1 represented by 2×RB1+RT1. RB1 represents a brush resistance of the first cleaning brush roller 102 and RT1 represents a resistance of the intermediate transfer belt 8 in the thickness direction. The second current path has a resistance R2 represented by 2×RB1+2×RB2+RT2. RB2 is a brush resistance of the second cleaning brush roller 106 and RT2 is a surface resistance of the intermediate transfer belt 8 between the first contact portion with the first cleaning part 100*a* and the second contact portion with the second cleaning part 100*b*.

Since the first cleaning brush roller 102 and the second cleaning brush roller 106 have the same configuration in the present embodiment, RB1=RB2 is satisfied. The distance between the first contact portion and the second contact portion is 9.4 mm and the contact nip width between the intermediate transfer belt 8 and the cleaning brush roller 102 or 106 is 8 mm. The resistance ratio R2/R1 of the second current path to the first current path is 82.

The inventors of the present invention have found that when the potential difference between the first cleaning brush roller 102 in the first cleaning part 100*a* and the second cleaning brush roller 106 in the second cleaning part 100*b* is 6,000 V or more and the resistance ratio of the second current path to the first current path satisfies R2/R1<100, the current readily flows from the first cleaning part 100*a* into the second cleaning part 100*b*. Therefore, if the voltage to be applied to the first cleaning part 100*a* is set independently from the second cleaning part 100*b*, a current flowing in normal operation may be deviated from the optimum current value. Accordingly, the voltage to be applied to one of the cleaning parts 100*a* and 100*b* is preferably set while applying a voltage to the other cleaning parts 100*a* and 100*b*, so that the optimum amount of current can flow in normal operation.

Specific resistance values in the present embodiment are shown below. The contact nip length of the cleaning brush roller 102 or 106 with the intermediate transfer belt 8 is 320 mm in the width direction of the intermediate transfer belt 8. The contact nip width of the cleaning brush roller 102 or 106 with the intermediate transfer belt 8 is 8 mm in the direction of movement of the surface of the intermediate transfer belt 8. The brush resistances RB1 and RB2 are $1\times10^7\Omega$ when the contact nip was subject to measurement upon application of a voltage of 1,000 V. The resistance RT1 of the intermediate transfer belt 8 in the thickness direction is calculated from the following equation: (the volume resistivity of the intermediate transfer belt 8)×(the thickness of the intermediate transfer belt 8)/(the area of the contact nip). In the present embodiment, RT1=$(1.91\times10^{10}[\Omega\cdot cm])\times(560\times10^{-4}[cm])/(32[cm]\times0.8[cm])=4.17\times10^7[\Omega]$. The surface resistance RT2 of the intermediate transfer belt 8 between the first contact portion and the second contact portion is calculated from the following equation: (the volume resistivity of the intermediate transfer belt 8)×(the distance between the first contact portion and the second contact portion)/(the contact nip length). In the present embodiment, RT2=$(1.70\times10^{11}[\Omega/\square])\times(0.94[cm])/(32[cm])=5\times10^9[\Omega]$. Thus, the resistance ratio of the second current path to the first current path R2/R1 is $(4\times10^7+5\times10^9)/(2\times10^7+4.17\times10^7)=(5.04\times10^9)/(6.17\times10^7)=82$.

In the present embodiment, the current amount (i.e., IB2+IC2) flowing in the second cleaning part 100*b* in normal operation is −50.2 μA. On the other hand, the current amount (i.e., IB2+IC2) is −19.1 μA when the voltage to be applied to the second cleaning part 100*b* is set while no voltage is applied to the first cleaning part 100*a*. The difference between −50.2 μA and −19.1 μA is considered to be a current amount which has flown from the first cleaning part 100*a* into the second cleaning part 100*b* via the surface of the intermediate transfer belt 8. When about 60% or more of the current flowing in the first cleaning part 100*a* flows into the second cleaning part 100*b* via the surface of the intermediate transfer belt 8, defective cleaning slightly occurs, resulting in an image graded "Average" as shown in Table 3. Referring to Table 3, in a case in which the voltage to be applied to the second cleaning part 100*b* is changed so that the current amount flowing in the second cleaning part 100*b* is increased, the current amount (i.e., IB2+IC2) flowing in the second cleaning part 100*b* becomes −332 μA, which results in an image graded "Poor" indicating the occurrence of defective cleaning.

In the above-described comparative example, when a voltage of −3,100 V is applied only to the second cleaning brush roller 106 in the second cleaning part 100*b* in the low-humidity and low-temperature condition, −19.1 μA of current flows, which is smaller than the optimum current value −23 μA. Similarly, when a voltage of +5,400 V is applied only to the first cleaning brush roller 102 in the first cleaning part 100*a*, 69 μA of current flows, which is smaller than the optimum current value 76 μA. When a voltage of +5,400 V is applied to the first cleaning brush roller 102 in the first cleaning part 100*a* and a voltage of −3,100 V is applied to the second cleaning brush roller 106 in the second cleaning part 100*b*, 84.6 μA of current flows in the first cleaning part 100*a* and −50.2 μA of current flows in the second cleaning part 100*b*, each of which are greater than the optimum current values. A current amount flowing from the first cleaning part 100*a* into the second cleaning part 100*b* is (−50.2 [μA])−(−19.1 [μA])=31.1 [μA]. The ratio is (31.1 [μA]/(50.2 [μA])=62%.

Another printer having a similar configuration to the above-described embodiment except that the distance between the first contact portion in the first cleaning part 100*a* and the second contact portion in the second cleaning part 100*b* is changed to 25 mm is also evaluated. In this printer, the resistance ratio R2/R1 is 216. When a voltage of −2,500 V is applied to the second cleaning brush roller 106 and a voltage of −2,900 V is applied to the second collecting roller 107 in the second cleaning part 100*b* while no voltage is applied to the first cleaning part 100*a*, the current amount (i.e., IB2+IC2) flowing in the second cleaning part 100*b* is −19 μA. A voltage of −6,200 V is applied to the first cleaning brush roller 102 and a voltage of −6,600 V is applied to the first collecting roller 103 while the above set voltage is applied to the second cleaning part 100*b*, the current amount (i.e., IB2+IC2) flowing in the second cleaning part 100*b* is −27 μA. The ratio of the current amount flowing into the second cleaning part 100*b* is 30% of the current flowing in the first cleaning part 100*a*. In this case, defective cleaning does not occur.

When there is a sufficient distance between the first contact portion and the second contact portion and the resistance value therebetween is sufficiently large, the resulting image is not adversely affected even when an adjacent cleaning part is not taken into consideration. By contrast, when the first contact portion and the second contact portion are closely positioned and the resistance value therebetween is not so large, as in the present embodiment, the voltage to be applied to one cleaning part should be set while applying a voltage to the other cleaning part so that the optimum amount of current flows in an actual normal operation.

Figure 8:
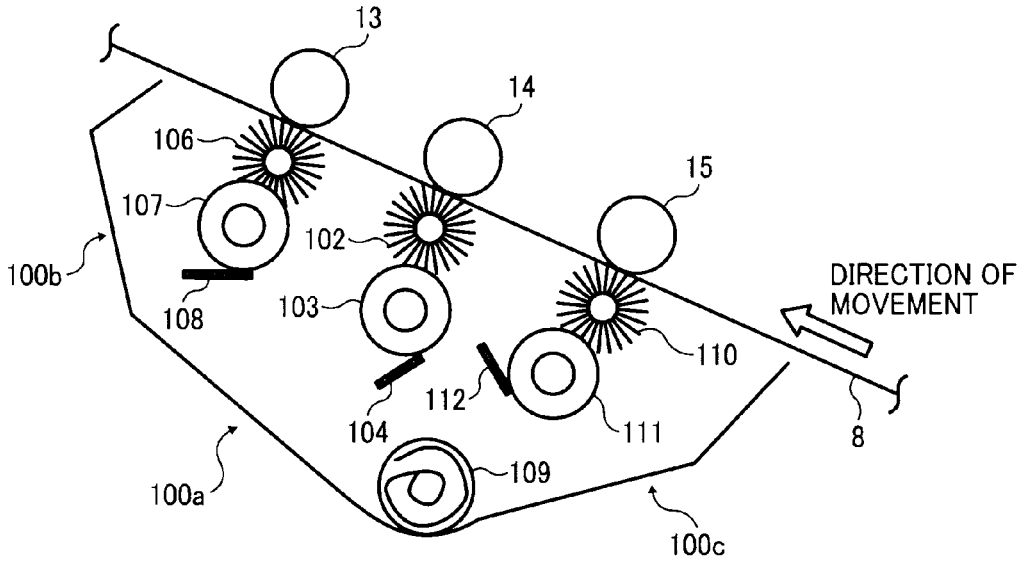
FIG. 8 is a schematic view illustrating another exemplary embodiment of the cleaning device.

FIG. 8 is a schematic view illustrating another exemplary embodiment of the cleaning device 100 further including a pre-cleaning part 100*c* in addition to the first and second cleaning parts 100*a* and 100*b* for removing normally-charged and oppositely-charged toner particles, respectively.

The pre-cleaning part 100*c* is applied with a constant positive voltage so that a predetermined amount of cleaning current flows. Thus, the pre-cleaning part 100*c* removes negatively-charged toner particles. The pre-cleaning part 100*c* has two setting tables for current values. One of them corresponds to untransferred toner particles which are not to be transferred and the other corresponds to residual toner particles which have not been transferred in normal image forming operations. In contrast to the above-described embodiment, the first cleaning part 100*a* is applied with a negative voltage so as to remove positively-charged toner particles. The first cleaning part 100*a* also charges toner particles to be fed from the first cleaning part 100*a* to the second cleaning part 100*b* to a uniform negative polarity. The second cleaning part 100*b* is applied with a positive voltage so as to remove negatively-charged toner particles.

The voltage to be applied to each of the rollers is adjusted while simultaneously applying a voltage to each of a third cleaning brush roller 110 and a third collecting roller 111 in the pre-cleaning part 100*c*, the first cleaning brush roller 102 and the first collecting roller 103 in the first cleaning part 100*a*, and the second cleaning brush roller 106 and the second collecting roller 107 in the second cleaning part 100*b*, from respective power sources, so that the optimum amount of current determined from the setting table can flow therein. The adjusted voltage values are stored in a memory to be used in normal image forming operations. The potential difference between each of the cleaning brush rollers and each of the collecting rollers is fixed at 400 V.

Suitable toner for use in the above-described image forming apparatuses according to exemplary embodiments is described in detail below. The toner preferably has a volume average particle diameter of 3 to 6 μm so as to reproduce micro dots having a resolution of 600 dpi or more. Preferably, the ratio (Dv/Dn) of the volume average particle diameter (Dv) to the number average particle diameter (Dn) of the toner is 1.00 to 1.40. As the ratio (Dv/Dn) approaches 1.00, the particle diameter distribution becomes narrower. Such a toner having a small particle diameter and a narrow particle diameter distribution has a uniform charge distribution, which can produce high-quality images without background fouling. In particular, such a toner exhibits high transfer efficiency in electrostatic transfer methods.

Figure 9:
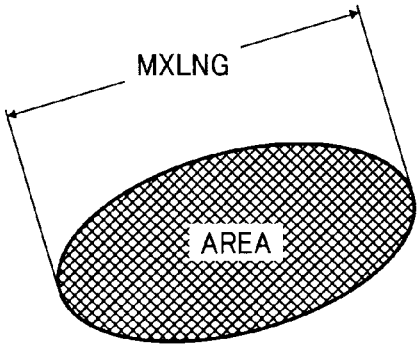
FIG. 9 is a schematic view illustrating a toner particle for explaining the shape factor SF-1.

The toner preferably has a shape factor SF-1 of 100 to 180 and another shape factor SF-2 of 100 to 180. FIG. 9 is a schematic view illustrating a toner particle for explaining the shape factor SF-1. The shape factor SF-1 represents the degree of roundness of a toner particle, and is represented by the following formula (1):

$$\text{SF-1}=\{(MXLNG)^2/\text{AREA}\}\times(100\pi)/4 \quad (1)$$

wherein MXLNG represents the maximum diameter of a projected image of a toner particle on a two-dimensional plane and AREA represents the area of the projected image. When SF-1 is 100, the toner particle has a true spherical shape. The greater the SF-1, the more irregular the toner shape.

Figure 10:
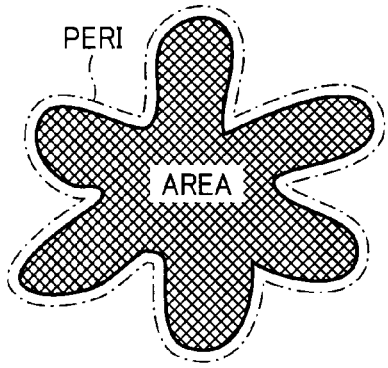
FIG. 10 is a schematic view illustrating a toner particle for explaining the shape factor SF-2.

FIG. 10 is a schematic view illustrating a toner particle for explaining the shape factor SF-2. The shape factor SF-2 represents the degree of roughness of a toner particle, and is represented by the following formula (2):

$$\text{SF-2}=\{(PERI)^2/\text{AREA}\}\times 100/(4\pi) \quad (2)$$

wherein PERI represents the peripheral length of a projected image of a toner particle on a two-dimensional plane and AREA represents the area of the projected image. When SF-2 is 100, the toner particle has a completely smooth surface without roughness. The greater the SF-2, the rougher the toner surface.

The shape factors are determined by obtaining a photographic image of toner particles with a scanning electron microscope (S-800 from Hitachi, Ltd.) and analyzing the photographic image with an image analyzer (LUZEX 3 from Nireco Corporation). Spherical toner particles are in point-contact with each other. Therefore, the adsorptive force between the spherical toner particles is small, resulting in high fluidity of the toner particles. Also, the adsorptive force between the toner particles and a photoreceptor is small, resulting in high transfer efficiency of the toner particles. When any one of the shape factors SF-1 and SF-2 exceeds 180, transfer efficiency may deteriorate.

The toner can be prepared by subjecting a toner composition liquid, in which a polyester prepolymer having a nitrogen-containing functional group, a polyester, a colorant, and a release agent are dissolved or dispersed in an organic solvent, to cross-linking and/or elongation reactions. Materials and manufacturing methods suitable for the toner are described in detail below.

The polyester can be obtained from a polycondensation reaction between a polyol and a polycarboxylic acid. The polyol (PO) may be, for example, a diol (DIO), a polyol (TO) having 3 or more valences, and a mixture thereof. A diol (DIO) alone or a mixture of a diol (DIO) with a small amount of a polyol (TO) is preferable. Specific examples of the diol (DIO) include, but are not limited to, alkylene glycols (e.g., ethylene glycol, 1,2-propylene glycol, 1,3-propylene glycol, 1,4-butanediol, 1,6-hexanediol), alkylene ether glycols (e.g., diethylene glycol, triethylene glycol, dipropylene glycol, polyethylene glycol, polypropylene glycol, polytetramethylene ether glycol), alicyclic diols (e.g., 1,4-cyclohexanedimethanol, hydrogenated bisphenol A), bisphenols (e.g., bisphenol A, bisphenol F, bisphenol S), alkylene oxide (e.g., ethylene oxide, propylene oxide, butylene oxide) adducts of the alicyclic diols, and alkylene oxide (e.g., ethylene oxide, propylene oxide, butylene oxide) adducts of the bisphenols. Among these diols, alkylene glycols having 2 to 12 carbon atoms and alkylene oxide adducts of bisphenols are preferable; and alkylene oxide adducts of bisphenols and mixtures of an alkylene oxide adducts of bisphenol with an alkylene glycol having 2 to 12 carbon atoms are more preferable. Specific examples of the polyol (TO) having 3 or more valences include, but are not limited to, polyvalent aliphatic alcohols having 3 or more valences (e.g., glycerin, trimethylolethane, trimethylolpropane, pentaerythritol, sorbitol), polyphenols having 3 or more valences (e.g., trisphenol PA, phenol novolac, cresol novolac), and alkylene oxide adducts of the polyphenols having 3 or more valences.

The polycarboxylic acid (PC) may be, for example, a dicarboxylic acid (DIC), a polycarboxylic acid (TC) having 3 or more valences, and a mixture thereof. A dicarboxylic acid (DIC) alone or a mixture of a dicarboxylic acid (DIC) with a small amount of a polycarboxylic acid (TC) is preferable. Specific examples of the dicarboxylic acid (DIC) include, but are not limited to, alkylene dicarboxylic acids (e.g., succinic acid, adipic acid, sebacic acid), alkenylene dicarboxylic acids (e.g., maleic acid, fumaric acid), and aromatic dicarboxylic acids (e.g., phthalic acid, isophthalic acid, terephthalic acid, naphthalenedicarboxylic acid). Among these dicarboxylic acids, alkenylene dicarboxylic acids having 4 to 20 carbon atoms and aromatic dicarboxylic acids having 8 to 20 carbon atoms are preferable. Specific examples of the polycarboxylic acid (TC) having 3 or more valences include, but are not limited to, aromatic polycarboxylic acids having 9 to 20 carbon atoms (e.g., trimellitic acid, pyromellitic acid). Additionally, anhydrides and lower alkyl esters (e.g., methyl ester, ethyl ester, isopropyl ester) of the above-described polycarboxylic acids are also usable as the polycarboxylic acid (PC).

The equivalent ratio [OH]/[COOH] of hydroxyl groups [OH] in the polyol (PO) to carboxyl groups [COOH] in the polycarboxylic acid (PC) is preferably 2/1 to 1/1, more preferably 1.5/1 to 1/1, and most preferably 1.3/1 to 1.02/1. The polyol (PO) and the polycarboxylic acid (PC) are subjected to a polycondensation reaction by being heated to 150 to 280° C. in the presence of an esterification catalyst (e.g., tetrabutoxy titanate, dibutyltin oxide), while optionally reducing pressure and removing the produced water, to obtain a polyester having a hydroxyl group. The polyester preferably has a hydroxyl value of 5 or more; and an acid value of 1 to 30, more preferably 5 to 20. Polyesters having a certain acid value is negatively chargeable and has affinity for paper, resulting in improvement of low-temperature fixability. When the acid value is too large, the resulting toner charge may be unstable in terms of environmental variation. The polyester preferably has a weight average molecular weight of 10,000 to 400,000, more preferably 20,000 to 200,000. When the weight average molecular weight is too small, hot offset resistance of the resulting toner may be poor. When the weight average molecular weight is too large, low-temperature fixability of the resulting toner may be poor.

The polyester may further include a urea-modified polyester other than an unmodified polyester obtainable from the above-described polycondensation reaction. The urea-modified polyester can be obtained by reacting terminal carboxyl or hydroxyl groups of the above-prepared polyester with a polyisocyanate (PIC) to prepare a polyester prepolymer (A) having an isocyanate group, and reacting the polyester prepolymer (A) with an amine to cross-link or elongate molecular chains. Specific examples of the polyisocyanate (PIC) include, but are not limited to, aliphatic polyisocyanates (e.g., tetramethylene diisocyanate, hexamethylene diisocyanate, 2,6-diisocyanatomethyl caproate), alicyclic polyisocyanates (e.g., isophorone diisocyanate, cyclohexylmethane diisocyanate), aromatic diisocyanates (e.g., tolylene diisocyanate, diphenylmethane diisocyanate), aromatic aliphatic diisocyanates (e.g., α,α,α',α'-tetramethylxylylene diisocyanate), isocyanurates, and the above polyisocyanates in which the isocyanate group is blocked with a phenol derivative, an oxime, or a caprolactam. Two or more of these compounds can be used in combination. The equivalent ratio [NCO]/[OH] of isocyanate groups [NCO] in the polyisocyanate (PIC) to hydroxyl groups [OH] in the polyester having a hydroxyl group is preferably 5/1 to 1/1, more preferably 4/1 to 1.2/1, and most preferably from 2.5/1 to 1.5/1. When the equivalent ratio [NCO]/[OH] is too large, low-temperature fixability of the resulting toner may be poor. When the equivalent ratio [NCO]/[OH] is too small, hot offset resistance of the resulting toner may be poor because the content of urea in the polyester prepolymer is too small. The polyester prepolymer (A) having an isocyanate group includes the polyisocyanate (PIC) units in an amount of 0.5 to 40% by weight, more preferably 1 to 30% by weight, and most preferably 2 to 20% by weight. When the ratio of the polyisocyanate (PIC) units is too small, hot offset resistance, heat-resistant storage stability, and low-temperature fixability of the resulting toner may be poor. When the ratio of the polyisocyanate (PIC) units is too large, low-temperature fixability of the resulting toner may be poor. The average number of isocyanate groups included in one molecule of the polyester prepolymer (A) having an isocyanate group is preferably 1 or more, more preferably 1.5 to 3, and most preferably 1.8 to 2.5. When the number of isocyanate groups per molecule is too small, hot offset resistance of the toner may be poor because the molecular weight of the resulting urea-modified polyester is too small.

The amine (B) to be reacted with the polyester prepolymer (A) may be, for example, a diamine (B1), a polyamine (B2) having 3 or more valences, an amino alcohol (B3), an amino mercaptan (B4), an amino acid (B5), or a blocked amine (B6) in which the amino group in any of the amines (B1) to (B5) is blocked.

Specific examples of the diamine (B1) include, but are not limited to, aromatic diamines (e.g., phenylenediamine, diethyltoluenediamine, 4,4'-diaminodiphenylmethane), alicyclic diamines (e.g., 4,4'-diamino-3,3'-dimethyldicyclohexylmethane, diaminocyclohexane, isophoronediamine), and aliphatic diamines (e.g., ethylenediamine, tetramethylenediamine, hexamethylenediamine). Specific examples of the polyamine (B2) having 3 or more valences include, but are not limited to, diethylenetriamine and triethylenetetramine. Specific examples of the amino alcohol (B3) include, but are not limited to, ethanolamine and hydroxyethylaniline. Specific examples of the amino mercaptan (B4) include, but are not limited to, aminoethyl mercaptan and aminopropyl mercaptan. Specific examples of the amino acid (B5) include, but are not limited to, aminopropionic acid and aminocaproic acid. Specific examples of the blocked amine (B6) include, but are not limited to, ketimine compounds obtained from the above-described amines (B1) to (B5) and ketones (e.g., acetone, methyl ethyl ketone, methyl isobutyl ketone), and oxazoline compounds. Among these amines (B), a diamine (B1) alone and a mixture of a diamine (B1) with a small amount of a polyamine (B2) having 3 or more valences are preferable.

The equivalent ratio [NCO]/[NHx] of isocyanate groups [NCO] in the polyester prepolymer (A) to amino groups [NHx] in the amine (B) is preferably 1/2 to 2/1, more preferably 1.5/1 to 1/1.5, and most preferably 1.2/1 to 1/1.2. When the equivalent ratio [NCO]/[NHx] is too large or small, hot offset resistance of the resulting toner may be poor because the molecular weight of the resulting urea-modified polyester is too small.

The urea-modified polyester may include urethane bonds other than urea bonds. In this case, the molar ratio of urea bonds to urethane bonds is preferably 100/0 to 10/90, more preferably 80/20 to 20/80, and most preferably 60/40 to 30/70. When the molar ratio of urea bonds is too small, hot offset resistance of the resulting toner may be poor.

The urea-modified polyester may be prepared by one-shot method. First, the polyol (PO) and the polycarboxylic acid (PC) are heated to 150 to 280° C. in the presence of an esterification catalyst (e.g., tetrabutoxy titanate, dibutyltin oxide), while optionally reducing pressure and removing the produced water, to obtain a polyester having a hydroxyl group. Next, the polyester having a hydroxyl group is reacted with a polyisocyanate (PIC) at 40 to 140° C., to obtain a polyester prepolymer (A) having an isocyanate group. The polyester prepolymer (A) is further reacted with the amine (B) at 0 to 140° C., to obtain a urea-modified polyester.

When reacting the polyisocyanate (PIC), or reacting the polyester prepolymer (A) with the amine (B), solvents can be used, if needed. Specific examples of usable solvents include, but are not limited to, aromatic solvents (e.g., toluene, xylene), ketones (e.g., acetone, methyl ethyl ketone, methyl isobutyl ketone), esters (e.g., ethyl acetate), amides (e.g., dimethylformamide, dimethylacetamide), and ethers (e.g., tetrahydrofuran), which are inactive against the polyisocyanate (PIC).

The cross-linking and/or elongation reaction between the polyester prepolymer (A) and the amine (B) can be terminated with a reaction terminator, if needed, to control the molecular weight of the resulting urea-modified polyester. Specific preferred examples of suitable reaction terminators include, but are not limited to, monoamines (e.g., diethylamine, dibutylamine, butylamine, laurylamine) and blocked monoamines (e.g., ketimine compounds).

The urea-modified polyester preferably has a weight average molecular weight of 10,000 or more, more preferably 20,000 to 10,000,000, and most preferably 30,000 to 1,000,000. When the weight average molecular weight is too small, hot offset resistance of the resulting toner may be poor. The urea-modified polyester is not limited in number average molecular weight when used in combination with the above-described unmodified polyester. When the urea-modified polyester is used alone, the urea-modified polyester preferably has a number average molecular weight of 2,000 to 15,000, more preferably 2,000 to 10,000, and most preferably 2,000 to 8,000. When the number average molecular weight is too large, low-temperature fixability of the resulting toner may be poor and the resulting image may have low gloss.

The combination of the unmodified polyester and the urea-modified polyester provides better low-temperature fixability and gloss compared to a case in which the urea-modified polyester is used alone. The unmodified polyester may include a polyester modified with a chemical bond other than urea bond.

It is preferable that the unmodified polyester and the urea-modified polyester are at least partially compatible with each other from the viewpoint of low-temperature fixability and hot offset resistance of the toner. Therefore, the unmodified polyester and the urea-modified polyester preferably have a similar chemical composition.

The weight ratio of the unmodified polyester to the urea-modified polyester is preferably 20/80 to 95/5, more preferably 70/30 to 95/5, much more preferably 75/25 to 95/5, and most preferably 80/20 to 93/7. When the ratio of the unmodified polyester is too small, hot offset resistance, heat-resistant storage stability, and low-temperature fixability of the resulting toner may be poor.

A binder resin including both the unmodified polyester and the urea-modified polyester has a glass transition temperature (Tg) of 45 to 65° C., more preferably 45 to 60° C. When the glass transition temperature is too low, heat resistance of the resulting toner may be poor. When the glass transition temperature is too high, low-temperature fixability of the resulting toner may be poor.

The resulting toner has better heat-resistant storage stability than typical polyester-based toners even when the toner has a low glass transition temperature, because the urea-modified polyester tends to exist at the surface of the toner particles.

Specific examples of usable colorants include, but are not limited to, carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR1, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. Two or more of these colorants can be used in combination. The content of the colorant in the toner is preferably 1 to 15% by weight, and more preferably 3 to 10% by weight.

The colorant can be combined with a resin to be used as a master batch. Specific examples of usable resins for the master batch include, but are not limited to, styrene-based polymers (e.g., polystyrene, poly-p-chlorostyrene, polyvinyl toluene), copolymers of the styrene-based polymers with vinyl compounds, polymethyl methacrylate, polybutyl methacrylate, polyvinyl chloride, polyvinyl acetate, polyethylene, polypropylene, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, and paraffin wax. Two or more of these resins can be used in combination.

Specific preferred examples of suitable charge controlling agents include, but are not limited to, nigrosine dyes, triphenylmethane dyes, chromium-containing metal complex dyes, chelate pigments of molybdic acid, Rhodamine dyes, alkoxyamines, quaternary ammonium salts (including fluorine-modified quaternary ammonium salts), alkylamides, phosphor and phosphor-containing compounds, tungsten and tungsten-containing compounds, fluorine activators, metal salts of salicylic acid, and metal salts of salicylic acid derivatives. Specific examples of commercially available charge controlling agents include, but are not limited to, BONTRON® 03 (nigrosine dye), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complexes of quaternary ammonium salts), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salts), which are manufactured by Hoechst AG; LR1-901, and LR-147 (boron complex), which are manufactured by Japan Carlit Co., Ltd.; and cooper phthalocyanine, perylene, quinacridone, azo pigments, and polymers having a functional group such as a sulfonate group, a carboxyl group, and a quaternary ammonium group. In particular, compounds which can control toner to have a negative polarity are preferable.

The content of the charge controlling agent is determined based on the kind of binder resin used, the presence or absence of other additives, and how the toner is manufactured. Preferably, the content of the charge controlling agent is 0.1 to 10 parts by weight, more preferably 0.2 to 5 parts by weight, based on 100 parts by weight of the binder resin, but is not limited thereto. When the content of charge controlling agent is too large, the toner may be excessively charged and thereby electrostatically attracted to a developing roller, resulting in poor fluidity of the developer and low image density.

The toner may include a wax having a low melting point of 50 to 120° C. as a release agent. Such a wax effectively functions as the release agent at an interface between a fixing roller and the toner. Thus, there is no need to apply a release oil to the fixing roller. Specific preferred examples of suitable waxes include, but are not limited to, natural waxes such as plant waxes (e.g., carnauba wax, cotton wax, sumac wax, rice wax), animal waxes (e.g., bees wax, lanolin), mineral waxes (e.g., ozokerite, ceresin), and petroleum waxes (e.g., paraffin wax, micro-crystalline wax, petrolatum wax); synthetic hydrocarbon waxes such as Fischer-Tropsch wax and polyethylene wax; and synthetic waxes of esters, ketone, and ethers. Further, the following materials are also suitable for the release agent: fatty acid amides such as 1,2-hydroxystearic acid amide, stearic acid amide, phthalic anhydride imide, and chlorinated hydrocarbon; and crystalline polyesters having a long alkyl side chain, such as poly-n-stearyl methacrylate and poly-n-lauryl methacrylate, which are a homopolymer or a copolymer of polyacrylates (e.g., n-stearyl polymethacrylate, n-lauryl polymethacrylate).

The charge controlling agent and release agent may be directly mixed with the binder resin or the master batch, or added to an organic solvent containing such toner components.

The toner may further include a particulate inorganic material on the surface thereof to improve fluidity, developability, and chargeability. The particulate inorganic material preferably has a primary particle diameter of $5\times10^{-3}$ to 2 μm, and more preferably $5\times10^{-3}$ to 0.5 μm. The particulate inorganic material preferably has a BET specific surface of 2 to 500 $m^2/g$. The content of the particulate inorganic material in the toner is preferably 0.01 to 5% by weight, and more preferably 0.01 to 2.0% by weight. Specific preferred examples of suitable particulate inorganic materials include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. In particular, a mixture of hydrophobized silica particles and hydrophobized titanium oxide particles is suitable as a fluidizer. Specifically, a mixture of hydrophobized silica particles and hydrophobized titanium oxide particles both having an average particle diameter of $5\times10^{-4}$ μm or less can be reliably held on the toner surface with improved electrostatic force and van der Waals force even when the toner is repeatedly agitated in a developing device, thereby producing high-quality image and reducing residual toner particles which are not transferred. Titanium oxide particles have advantages in terms of environmental stability and image density stability, however, they have a disadvantage in terms of charge rising ability. Thus, too large a mixing ratio of titanium oxide particles to silica particles is disadvantageous. When the contents of hydrophobized silica particles and hydrophobized titanium oxide particles are 0.3 to 1.5% by weight, charge rising ability is not so deteriorated that high image quality can be reliably produced for an extended period of time.

An exemplary method of manufacturing the toner is described below.

(1) A toner components liquid is prepared by dispersing or dissolving a colorant, an unmodified polyester, a polyester prepolymer having an isocyanate group, and a release agent in an organic solvent. Preferably, the organic solvent is a volatile solvent having a boiling point less than 100° C., which is easily removable from the resulting particles. Specific examples of such solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. Two or more of these solvents can be used in combination. Among these solvents, aromatic solvents (e.g., toluene, xylene) and halogenated hydrocarbons (e.g., methylene chloride, 1,2-dichloroethane, chloroform, carbon tetrachloride) are preferable. The amount of the solvent is preferably 0 to 300 parts by weight, more preferable 0 to 100 parts by weight, and most preferably 25 to 70 parts by weight, based on 100 parts by weight of the polyester prepolymer.

(2) The toner components liquid is emulsified in an aqueous medium in the presence of a surfactant and a particulate resin. The aqueous medium may be, for example, water alone, or a mixture of water with an alcohol (e.g., methanol, isopropyl alcohol, ethylene glycol), dimethylformamide, tetrahydrofuran, a cellosolve (e.g., methyl cellosolve), or a lower ketone (e.g., acetone, methyl ethyl ketone).

The amount of the aqueous medium is preferably 50 to 2,000 parts by weight, more preferably 100 to 1,000 parts by weight, based on 100 parts by weight of the toner components liquid. When the amount of the aqueous medium is too small, the toner components may not be finely dispersed, and the resulting toner particles may not have a desired particle size. When the amount of the aqueous medium is too large, manufacturing cost may increase.

To improve dispersing ability, a dispersant, such as a surfactant and a particulate resin, is added to the aqueous medium. Specific preferred examples of suitable surfactants include, but are not limited to, anionic surfactants such as α-olefin sulfonate and phosphates; cationic surfactants such as amine salt type surfactants (e.g., alkylamine salts, amino alcohol fatty acid derivatives, polyamine fatty acid derivatives, imidazoline) and quaternary ammonium salt type surfactants (e.g., alkyl trimethyl ammonium salt, dialkyl dimethyl ammonium salt, alkyl dimethyl benzyl ammonium salt, pyridinium salt, alkyl isoquinolinium salt, and benzethonium chloride); nonionic surfactants such as fatty acid amide derivatives and polyvalent alcohol derivatives; and ampholytic surfactants such as alanine, dodecyldi(aminoethyl) glycine, and N-alkyl-N,N-dimethyl ammonium betaine.

Surfactants having a fluoroalkyl group can achieve an effect in a small amount. Specific preferred examples of suitable anionic surfactants having a fluoroalkyl group include, but are not limited to, fluoroalkyl carboxylic acids having 2 to 10 carbon atoms and metal salts thereof, perfluorooctane sulfonyl glutamic acid disodium, 3-[ω-fluoroalkyl(C6-C11) oxy]-1-alkyl(C3-C4) sulfonic acid sodium, 3-[ω-fluoroalkanoyl(C6-C8)-N-ethylamino]-1-propane sulfonic acid sodium, fluoroalkyl(C11-C20) carboxylic acids and metal salts thereof, perfluoroalkyl(C7-C13) carboxylic acids and metal salts thereof, perfluoroalkyl(C4-C12) sulfonic acids and metal salts thereof, perfluorooctane sulfonic acid dimethanol amide, N-propyl-N-(2-hydroxyethyl) perfluorooctane sulfonamide, perfluoroalkyl(C6-C10) sulfonamide propyl trimethyl ammonium salts, perfluoroalkyl(C6-C10)-N-ethyl sulfonyl glycine salts, and monoperfluoroalkyl(C6-C16) ethyl phosphates.

Specific examples of commercially available such anionic surfactants having a fluoroalkyl group include, but are not limited to, SURFLON® S-111, S-112, and S-113 (from AGC Seimi Chemical Co., Ltd.); FLUORAD FC-93, FC-95, FC-98, and FC-129 (from Sumitomo 3M); UNIDYNE DS-101 and DS-102 (from Daikin Industries, Ltd.); MEGAFACE F-110, F-120, F-113, F-191, F-812, and F-833 (from DIC Corporation); EFTOP EF-102, 103, 104, 105, 112, 123A, 123B, 306A, 501, 201, and 204 (from Mitsubishi Materials Electronic Chemicals Co., Ltd.); and FTERGENT F-100 and F-150 (from Neos Company Limited).

Specific preferred examples of suitable cationic surfactants having a fluoroalkyl group include, but are not limited to, aliphatic primary, secondary, and tertiary amine acids having a fluoroalkyl group, aliphatic quaternary ammonium salts such as perfluoroalkyl(C6-C10) sulfonamide propyl trimethyl ammonium salts, benzalkonium salts, benzethonium chlorides, pyridinium salts, and imidazolinium salts. Specific examples of commercially available cationic surfactants having a fluoroalkyl group include, but are not limited to, SURFLON® S-121 (from AGC Seimi Chemical Co., Ltd.); FLUORAD FC-135 (from Sumitomo 3M); UNIDYNE DS-202 (from Daikin Industries, Ltd.); MEGAFACE F-150 and F-824 (from DIC Corporation); EFTOP EF-132 (from Mitsubishi Materials Electronic Chemicals Co., Ltd.); and FTERGENT F-300 (from Neos Company Limited).

The particulate resin stabilizes mother toner particles formed in the aqueous medium. An appropriate amount of the particulate resin is added to the aqueous medium so that the coverage of the particulate resin on the surfaces of the mother toner particles becomes 10 to 90%. For example, the particulate resin may be a particulate polymethyl methacrylate having a particle diameter of 1 or 3 μm, a particulate polystyrene having a particle diameter of 0.5 or 2 μm, or a particulate poly(styrene-acrylonitrile) having a particle diameter of 1 μm. Specific examples of commercially available particulate resins include, but are not limited to, PB-200H (from Kao Corporation), SGP (from Soken Chemical & Engineering Co., Ltd.), TECHPOLYMER SB (from Sekisui Plastics Co., Ltd.), SGP-3G (from Soken Chemical & Engineering Co., Ltd.), and MICROPEARL (from Sekisui Chemical Co., Ltd.). Additionally, inorganic dispersants such as tricalcium phosphate, calcium carbonate, titanium oxide, colloidal silica, and hydroxyapatite are also usable.

Polymeric protection colloids can be used in combination with the above-described particulate resins and inorganic dispersants to more stabilize liquid droplets in the dispersion. Specific examples of usable polymeric protection colloids include, but are not limited to, homopolymers and copolymers obtained from monomers, such as acids (e.g., acrylic acid, methacrylic acid, α-cyanoacrylic acid, α-cyanomethacrylic acid, itaconic acid, crotonic acid, fumaric acid, maleic acid, maleic anhydride), hydroxyl-group-containing acrylates and methacrylates (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate), vinyl alcohols and vinyl alcohol ethers (e.g., vinyl methyl ether, vinyl ethyl ether, vinyl propyl ether), esters of vinyl alcohols with carboxyl-group-containing compounds (e.g., vinyl acetate, vinyl propionate, vinyl butyrate), amides (e.g., acrylamide, methacrylamide, diacetone acrylamide) and methylol compounds thereof (e.g., N-methylol acrylamide, N-methylol methacrylamide), acid chlorides (e.g., acrylic acid chloride, methacrylic acid chloride), and monomers containing nitrogen or a nitrogen-containing heterocyclic ring (e.g., vinyl pyridine, vinyl pyrrolidone, vinyl imidazole, ethylene imine); polyoxyethylenes (e.g., polyoxyethylene, polyoxypropylene, polyoxyethylene alkylamine, polyoxypropylene alkylamine, polyoxyethylene alkylamide, polyoxypropylene alkylamide, polyoxyethylene nonyl phenyl ether, polyoxyethylene lauryl phenyl ether, polyoxyethylene stearyl phenyl ester, polyoxyethylene nonyl phenyl ester); and celluloses (e.g., methyl cellulose, hydroxyethyl cellulose, hydroxypropyl cellulose).

The toner components liquid is dispersed in the aqueous medium using a low-speed shearing disperser, a high-speed shearing disperser, a frictional disperser, a high-pressure jet disperser, or an ultrasonic disperser, for example. A high-speed shearing disperser is preferable when controlling the particle diameter of the dispersing liquid droplets into 2 to 20 μm. As for the high-speed shearing disperser, the revolution is preferably 1,000 to 30,000 rpm, and more preferably 5,000 to 20,000 rpm. The dispersing time is preferably 0.1 to 5 minutes for a batch type. The dispersing temperature is preferably 0 to 150° C. (under pressure), and more preferably 40 to 98° C.

(3) At the time of emulsification, an amine (B) is added to the aqueous medium so that the amine (B) reacts with the polyester prepolymer (A) to cross-link or elongate their molecular chains. The reaction time between the prepolymer (A) and the amine (B) is preferably 10 minutes to 40 hours, and more preferably from 2 to 24 hours. The reaction temperature is preferably 0 to 150° C., and more preferably 40 to 98° C. A catalyst can be used, if needed. Specific examples of usable catalyst include, but are not limited to, dibutyltin laurate and dioctyltin laurate.

(4) After termination of the reaction, the organic solvent is removed from the emulsion (i.e., reaction products), followed by washing and drying, to obtain mother toner particles. To remove the organic solvent, the emulsion is gradually heated while being agitated with a laminar airflow. In particular, the organic solvent is removed after the emulsion is strongly agitated within a certain temperature range so that the resulting mother toner particles have a spindle shape. In a case in which a dispersant soluble in acids and bases (e.g., calcium phosphate) is used, the resulting toner particles are first washed with an acid (e.g., hydrochloric acid) and then washed with water to remove the dispersant. Alternatively, such a dispersant can be removed with an enzyme.

(5) The surfaces of the mother toner particles are treated with a charge controlling agent and inorganic particles, such as silica particles and titanium oxide particles, to obtain toner particles. More specifically, the charge controlling agent and the inorganic particles are externally added to the surfaces of the mother toner particles using a mixer.

Thus, toner particles having a small particle diameter and a narrow particle diameter distribution can be obtained. Strong agitation in the solvent removal process makes the resulting particles have a variety of shapes, from a spherical shape to a rugby ball shape, and a variety of surface conditions, from a smooth surface to a dimpled surface.

Figure 11A:
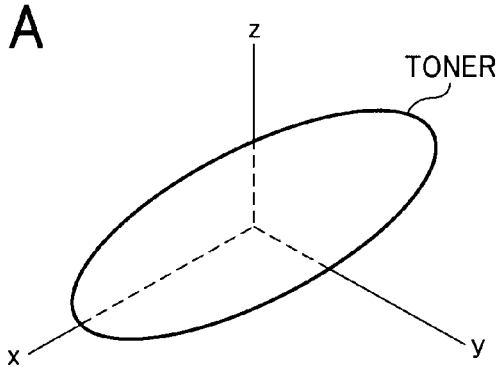
FIGS. 11A, 11B, and 11C are schematic views illustrating a toner particle.
Figure 11B:
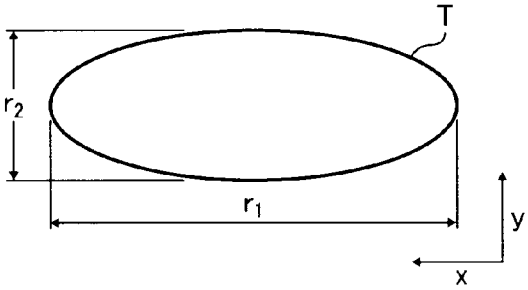
Figure 11C:
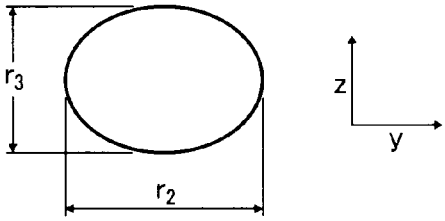

The toner has a substantially spherical shape represented by the following shape factors. FIGS. 11A, 11B, and 11C are schematic views illustrating a toner particle. The long axis, short axis, and thickness of the toner particle are represented by r1, r2, and r3, respectively, and a formula r1≥r2≥r3 is satisfied. Referring to FIG. 11B, the ratio (r2/r1) of the short axis r2 to the long axis r1 is preferably 0.5 to 1.0. Referring to FIG. 11C, the ratio (r3/r2) of the thickness r3 to the short axis r2 is preferably 0.7 to 1.0. When the ratio (r2/r1) of the short axis r2 to the long axis r1 is too small, it means that the toner particle has a shape far from a sphere. Such toner particle cannot produce high quality image because of having poor dot reproducibility and transfer efficiency. When the ratio (r3/r2) of the thickness r3 to the short axis r2 is too small, it means that the toner particle has a flat shape. Such toner particle cannot provide high transfer efficiency unlike spherical toner particles. When the ratio (r3/r2) of the thickness r3 to the short axis r2 is 1.0, it means that the toner particle is a body of rotation, the rotational axis of which is the long axis. Such toner particles have high fluidity.

The long axis r1, short axis r2, and thickness r3 are measured from photographs obtained using a scanning electron microscope (SEM) while varying the view angle.

Figure 12:
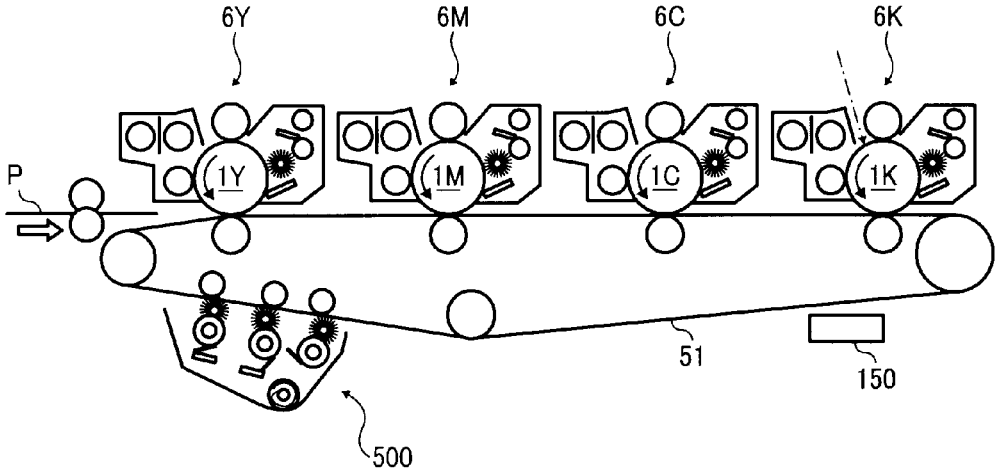
FIG. 12 is a schematic view illustrating another image forming apparatus according to exemplary embodiments of the invention.

FIG. 12 is a schematic view illustrating another image forming apparatus according to exemplary embodiments of the invention. This image forming apparatus includes a conveyance belt cleaning device 500 that cleans a paper conveyance belt 51. The conveyance belt cleaning device 500 has a similar configuration to the belt cleaning device 100 that cleans the peripheral surface of the intermediate transfer belt. The image forming apparatus illustrated in FIG. 12 employs a tandem direct transfer method in which the paper conveyance belt 51 is in contact with the photoreceptors 1Y, 1M, 1C, and 1K to form primary transfer nips for yellow, magenta, cyan, and black toner images, respectively. The paper conveyance belt 51 conveys the recording medium P held on its surface from the left toward the right in FIG. 12 to feed it into the primary transfer nips during its endless movement. Thus, toner images of yellow, magenta, cyan, and black are superimposed on and transferred onto the recording medium P. After passing the primary transfer nip for black toner image, the paper conveyance belt 51 is cleaned by the conveyance belt cleaning device 500. An optical sensor unit 150 is disposed facing an outer peripheral surface of the paper conveyance belt 51 forming a predetermined gap therebetween. The image forming apparatus executes an image density control and a position deviation correction at a predetermined timing and forms predetermined toner patterns (e.g., gradation patterns, Chevron patches) on the paper conveyance belt 51. The control or correction is executed based on the detection results from the optical sensor unit 150. After the optical sensor unit 150 detects the toner patterns, the conveyance belt cleaning device 500 removes the toner patterns from the paper conveyance belt 51. The paper conveyance belt 51 has a function of bearing a toner image. In this embodiment, toner images do not contact the paper conveyance belt 51 because they are directly transferred onto the recording medium P. Only the predetermined toner patterns (e.g., gradation patterns, Chevron patches) are formed on the paper conveyance belt 51.

The conveyance belt cleaning device 500 can reliably cleans the paper conveyance belt 51 for an extended period of time.

Figure 13:
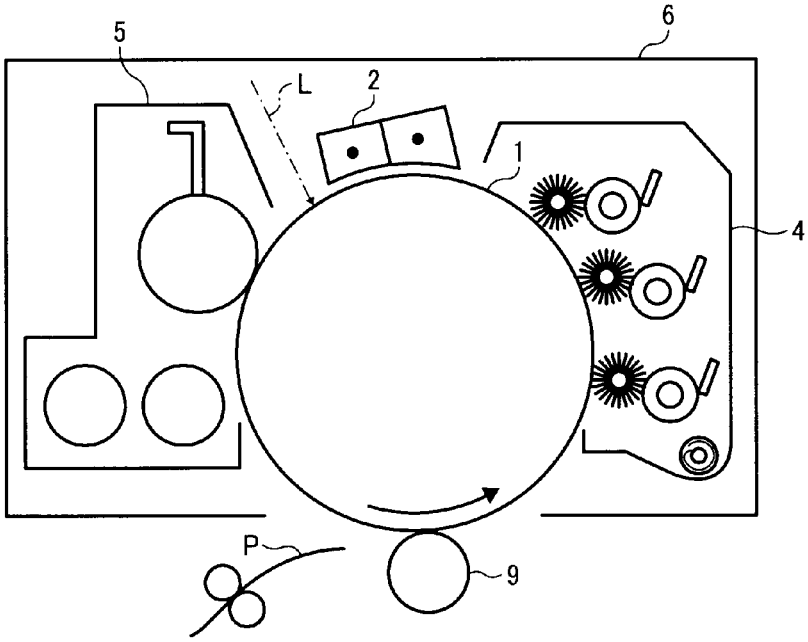
FIG. 13 is a schematic view illustrating another image forming apparatus according to exemplary embodiments of the invention.

FIG. 13 is a schematic view illustrating another image forming apparatus according to exemplary embodiments of the invention, including a drum cleaning device 4 that cleans a photoreceptor drum 1. The drum cleaning device 4 has a similar configuration to the belt cleaning device 100. The drum cleaning device 4 removes residual toner particles which are not transferred from the photoreceptor drum 1 in the normal image forming operations, toner consuming patterns formed on the photoreceptor drum 1 in the refresh mode, and untransferred toner images remaining on photoreceptor drum 1 due to paper jamming. The drum cleaning device 4 can reliably removes toner particles from the photoreceptor drum 1.

Additional modifications and variations of the present invention are possible in light of the above teachings. It is therefore to be understood that within the scope of the appended claims the invention may be practiced other than as specifically described herein.

What is claimed is:

1. An image forming apparatus, comprising:

a setting memory that stores multiple voltage settings;

two or more voltage applying cleaning members in contact with a voltage applied member at respective contact positions which are closely arranged, the two or more voltage applying cleaning members are simultaneously applied with respective voltages selected from the voltage settings;

two or more voltage applying collecting members, each of the two or more voltage applying collecting members is in contact with a respective voltage applying cleaning member;

two or more sets of current detectors, each set of current detectors detects a current flowing in a respective contact position based on a current detected for a voltage applied to a corresponding voltage applying cleaning member by a respective first power supply and a current detected for a voltage applied to a corresponding voltage applying collecting member by a respective second power supply; and a setting changer that performs a setting changing process in which a voltage applied to one of the voltage applying cleaning members is changed based on a current detected by one of the two or more sets of current detectors for a contact position of an other of the two or more voltage applying cleaning members and corresponding voltage applying collecting member while a predetermined voltage is applied to the other of the two or more voltage applying cleaning members, wherein the voltage applied member is an image bearing member or a recording medium conveying member.

2. The image forming apparatus according to claim 1, wherein each of the two or more voltage applying cleaning members is a cleaning member that electrostatically removes toner particles adhered to the voltage applied member.

3. The image forming apparatus according to claim 2, wherein two of the two or more voltage applying cleaning members are adjacent voltage applying cleaning members, and one of the adjacent voltage applying cleaning members is applied with a positive voltage and the other of the adjacent voltage applying cleaning members is applied with a negative voltage.

4. The image forming apparatus according to claim 3, wherein an absolute difference between the positive voltage and the negative voltage is 6 kV or more, wherein a distance between respective contact positions of the adjacent voltage applying cleaning members is set so that a ratio R2/R1 is less than 100, wherein R1 is a resistance of a current path flowing from the adjacent voltage applying cleaning member applied with the positive voltage into an inside of the voltage applied member, and R2 is a resistance of another current path flowing from the adjacent voltage applying cleaning member applied with the positive voltage into the adjacent voltage applying cleaning member applied with the negative voltage via a surface of the voltage applied member.

5. The image forming apparatus according to claim 4, wherein the distance between the respective contact positions of the adjacent voltage applying cleaning members is set so that 60% of a current flowing in the adjacent voltage applying cleaning member applied with the positive voltage flows into the adjacent voltage applying cleaning member applied with the negative voltage.

6. The image forming apparatus according to claim 1, wherein the setting changer performs the setting changing process at a time when the image forming apparatus is powered on.

7. The image forming apparatus according to claim 1, further comprising an image quality controller performing an image quality control at a predetermined timing, the setting changer performs the setting changing process at a time when the image quality controller performs the image quality control.

8. The image forming apparatus according to claim 7, wherein the setting changer performs the setting changing process before the image quality controller performs the image quality control.

9. The image forming apparatus according to claim 1, further comprising a detector detecting at least one of temperature and humidity, the setting changer performs the setting changing process at a time when the detected temperature or humidity satisfies a predetermined condition.

10. The image forming apparatus according to claim 1, further comprising:

an image quality controller performing an image quality control at a predetermined timing; and an image forming operation controller controlling image forming operation based on one operation mode selected from multiple operation modes, the setting memory storing multiple voltage settings with respect to each of the multiple operation modes, and the setting changer performs the setting changing process only in a specified operation mode selected from the multiple operation modes at a time when the image forming apparatus is powered on or the image quality controller performs the image quality control.

11. The image forming apparatus according to claim 10, wherein the multiple operation modes each correspond to a different surface movement speed of the voltage applied member.

12. The image forming apparatus according to claim 11, wherein the setting changer performs an other setting changing process in an operation mode other than the specified operation mode at a time other than the time when the image forming apparatus is powered on or the image quality controller performs the image quality control, and wherein the setting changer, in the other setting changing process, calculates a ratio in surface movement speed of the voltage applied member between the specified operation mode and the other operation mode, calculates an optimum current to flow in the other operation mode based on an optimum current flowing in the specified operation mode and the ratio in surface movement speed of the voltage applied member, and changes a voltage applied to one of the two or more voltage applying cleaning members so that the optimum current flows in the other operation mode.

13. A method of changing voltage settings, comprising:

applying respective voltages to multiple voltage applying cleaning members contacting a voltage applied member at respective contact positions close to each other with respective first power supplies;

applying respective voltages to multiple voltage applying collecting members with respective second power supplies, each voltage applying collecting member provided at a respective contact position contacting a respective voltage applying cleaning member;

detecting a respective first current for a respective voltage applied to each of the voltage applying cleaning members;

detecting a respective second current for a respective voltage applied to each of the voltage applying collecting members;

detecting a current flowing in each contact position based on a first current and a second current corresponding to each contact position; and changing a voltage applied to one voltage applying cleaning member corresponding to one contact position based on first and second currents detected at an other contact position while a predetermined voltage is applied to a voltage applying cleaning members corresponding to the other contact position.

14. An image forming apparatus, comprising:

a setting memory that stores multiple voltage settings;

two or more voltage applying members in contact with a voltage applied member at respective contact positions which are closely arranged, the two or more voltage applying members are applied with respective voltages selected from the voltage settings simultaneously;

two or more current detectors that each detects current flowing in respective contact positions; and a setting changer that performs a setting changing process in which a voltage applied to one of the two or more voltage applying members is changed based on a current detected by one of the two or more current detectors corresponding to a respective contact position of an other of the two or more voltage applying members while a predetermined voltage is applied to the other of the two or more voltage applying members, wherein the voltage applied member is an image bearing member or a recording medium conveying member, wherein each of the two or more voltage applying members is a cleaning member that electrostatically removes toner particles adhered to the voltage applied member, wherein two of the two or more voltage applying members are adjacent voltage applying members, and one of the adjacent voltage applying members is applied with a positive voltage and the other of the adjacent voltage applying members is applied with a negative voltage, wherein an absolute difference between the positive voltage and the negative voltage is 6 kV or more, wherein a distance between respective contact positions of the adjacent voltage applying members is set so that a ratio R2/R1 is less than 100, wherein R1 is a resistance of a current path flowing from the adjacent voltage applying member applied with the positive voltage into an inside of the voltage applied member, and R2 is a resistance of another current path flowing from the adjacent voltage applying member applied with the positive voltage into the adjacent voltage applying member applied with the negative voltage via a surface of the voltage applied member.

* * * * *